US005706984A

United States Patent [19]

Tada et al.

[11] Patent Number: 5,706,984

[45] Date of Patent: Jan. 13, 1998

[54] PUMP DISPENSER AND A METHOD OF ASSEMBLING THE PUMP DISPENSER

[75] Inventors: Tetsuya Tada; Atsushi Tada, both of Tokyo, Japan

[73] Assignee: Canyon Corporation, Tokyo, Japan

[21] Appl. No.: 571,508

[22] Filed: Dec. 13, 1995

[30] Foreign Application Priority Data

| | | | |
|---|---|---|---|
| Dec. 24, 1994 | [JP] | Japan | 6-335961 |
| Sep. 8, 1995 | [JP] | Japan | 7-256849 |
| Dec. 4, 1995 | [JP] | Japan | 7-339977 |

[51] Int. Cl.[6] ..... B67D 5/42

[52] U.S. Cl. ..... 222/182; 222/383.1

[58] Field of Search ..... 222/182, 383.1, 222/372; 239/333

[56] References Cited

U.S. PATENT DOCUMENTS

| | | | |
|---|---|---|---|
| 3,820,721 | 6/1974 | Hellenkamp | 222/182 X |
| 4,191,313 | 3/1980 | Blake et al. | 222/383.1 |
| 4,241,853 | 12/1980 | Pauls et al. | 222/383.1 X |
| 4,257,539 | 3/1981 | Cary et al. | 222/383.1 |
| 4,361,256 | 11/1982 | Corsette | 222/383.1 |
| 4,911,361 | 3/1990 | Tada | 222/383.1 |
| 4,921,017 | 5/1990 | Tada | 137/843 |
| 4,940,186 | 7/1990 | Tada | 222/383.1 |
| 4,953,791 | 9/1990 | Tada | 222/383.1 |
| 4,958,754 | 9/1990 | Dennis | 222/383.1 |
| 5,156,304 | 10/1992 | Battegazzore | 222/383.1 |
| 5,366,121 | 11/1994 | Foster et al. | 222/383.1 |

FOREIGN PATENT DOCUMENTS

| | | | |
|---|---|---|---|
| 57-32626 | 7/1982 | Japan . | |
| 3-212361 | 9/1991 | Japan | 222/383.1 |
| 2 244 522 | 12/1991 | United Kingdom . | |
| WO 93/17956 | 9/1993 | WIPO . | |

*Primary Examiner*—Kenneth Bomberg

*Attorney, Agent, or Firm*—Frishauf, Holtz, Goodman, Langer & Chick

[57] ABSTRACT

A cover is laterally mounted on an inner assembly which is a unit including all structural elements except for the cover. The cover is fixed to the inner assembly at three portions. A fitting projection provided on the upper surface of a nozzle base is received in a fitting hole formed in the upper surface of the ceiling of the cover. A pair of opposed engaging pieces are formed on the lower surface of a cylinder and the upper surface of a valve assembly, respectively. An engaging piece engaging with a space between the opposed engaging pieces is formed on the lower end of the cover. A horizontal engaging groove is formed in the upper surface of the nozzle base behind the fitting projection on the nozzle base and a projection engageable with the engaging groove is formed on the inner surface of the ceiling of the cover.

23 Claims, 16 Drawing Sheets

PUMP DISPENSER AND A METHOD OF ASSEMBLING THE PUMP DISPENSER

BACKGROUND OF THE INVENTION

1. Field of the Invention

This invention relates to a pump dispenser in which a liquid in a container is sucked into a cylinder and compressed to flow out from the cylinder by reciprocating a piston in cooperation with an angular movement of a trigger and a method of assembling the pump dispenser.

2. Description of the Prior Art

In order to solve the problem of the natural circumstance in that the ozone layer should be protected from being destroyed by a Freon gas, attention has come to be paid to a pump dispenser in which the reciprocation of piston cooperating with the angular movement of a trigger causes a liquid to be sucked into a cylinder and to be compressed to flow out from the cylinder, without using the Freon gas.

The pump dispenser of this kind is mounted by means of a bottle cap on the neck portion of the container holding a liquid to be made to flow out. The trigger is pivotally mounted on a cover, for example, and the piston is moved to a push-in position (the inner position) in a cylinder in cooperation with the traction of the trigger against a biasing force of a return spring.

Upon releasing the traction force on the trigger, the trigger is returned to the initial position (the outer position) by the biasing force of the return spring and the piston is also returned to the initial position in cooperation with the movement of the trigger. When the piston is returned from the push-in position (the inner position) to the initial position, the interior of the cylinder is negatively pressurized.

In an example, the cover has a hollow form having an approximate U-shaped cross section opened at the front and lower ends. The cylinder is formed integrally with the cover and a valve housing is fixedly fitted in the cover at its lower end. A primary valve for controlling the flow-in of the liquid into the cylinder is provided in a flow-in passageway of the liquid and a secondary valve for controlling the flow-out of the liquid from the cylinder is provided in a flow-out passageway of the liquid. As the interior of the cylinder is negatively pressurized, the primary valve is opened and the secondary valve is closed.

Under the negative pressure, the liquid in the container is sucked up into the cylinder through a suction tube and the primary valve by removing the remaining air in the cylinder. As the trigger is pulled against the biasing force of the return spring, the piston is pushed to pressurize the liquid in the cylinder. Then, the pressurized liquid opens the secondary valve and flows out from the cylinder. Thereafter, the pressurized liquid flows into the flow-out passageway through the secondary valve and then flows out from an orifice (a flow-out hole) formed in a nozzle which is mounted on the front end of the flow-out passageway.

In the recent pump dispenser, its structural elements such as the cover, the trigger, the piston, the cylinder, the valve housing and the bottle cap as well as the return spring are injection molded from plastics material so that they can be recycled.

The nozzle and trigger are inevitably exposed externally. Since, however, relatively large structural elements such as the piston, the cylinder and the valve housing are almost covered with the cover, the design of the pump dispenser itself is mostly determined by the design of the cover.

In general, pump dispensers are not sold directly to final users but to detergent distributors and the like at first. After the pump dispensers have been attached by the detergent distributors and the like to containers filled with a liquid such as a detergent solution, a shampoo solution, an antiseptic solution or the like prepared by the distributors, the pump dispensers are sold to the final users.

The pump dispensers as final products can be obtained by fixedly fitting suction tubes to the lower ends of the valve housings. When, however, the pump dispensers may be delivered to the distributors without the suction tubes and the suction tubes may be fixedly fitted by the detergent distributors, because (1) the suction tubes have different lengths according to the heights of the containers and (2) it is not advantageous that the pump dispenser becomes too long to be transported to each distributor when it is supplied to the distributors with the suction tube mounted in the pump dispenser.

As described above, the design of the pump dispenser itself is almost determined by the design of the cover and covers having various designs according to the needs of the distributors are manufactured.

The U.S. Pat. Nos. 4,911,361, 4,940,186 and 4,953,791 all patented to Atsushi Tada disclose pump dispensers each having a piston, a nozzle cap, a cylinder and a trigger previously formed as a unit or an inner assembly and its assembling method. A cover is mounted on the upper portion of the inner assembly and a bottle cap and a packing (a sealing collar) are provided on the lower portion of the inner assembly. The bottle cap and the packing are pressed against the cap to sandwich the inner assembly. The bottle cap and packing are fitted in and engaged with the lower end of the cover whereby the inner assembly, the bottle cap and the sealing collar are mounted in the cover.

The pump dispensers disclosed in the above-mentioned United States Patents have the following advantages:

(1) the inner assembly having the same structure and size can be commonly used when pump dispensers having a variety of custom designs are manufactured;

(2) the pump dispensers having designs needed by the distributors (i.e., having custom designs) can be obtained merely by covering common inner assemblies with covers having the needed designs, and this technique can be fully applied to the assembling of pump dispensers having a variety of custom designs;

(3) since each of the pump dispensers can be assembled by mounting the cover on the upper portion of the inner assembly from above and the bottle cap and the sealing collar on the lower portion of the inner assembly from beneath without requiring high assembly technique, the pump dispensers can be assembled in a knockdown way even in any developing countries; and (4) use of common inner assemblies allows mass production, leading to production of pump dispensers at a low cost.

However, the bottle cap, and the packing (the sealing collar) are not assembled into the inner assembly, and not all the structural elements except for the cover are unitarily formed as an inner assembly. Thus, it is necessary not only to mount the cover on the inner assembly but also to mount the bottle cap and the packing on the inner assembly independently from the mounting step of the cover on the inner assembly in order to manufacture a pump dispenser.

In this respect, the pump dispenser disclosed in each of the abovementioned United States Patents is not sufficient in that not all the structural elements other than the cover are unitarily formed. It should be noted, however, that the technical concept of the unitary construction of the structural elements other than the cover has a great advantage in that this concept can be applied to a large variety of the custom designs of the covers and this construction allows for easy assembly of the pump dispenser.

U.S. Pat. No. 5,156,304 patented to Piero Battegazzore discloses a pump dispenser in which not only all structural elements except for a cover can be formed unitarily as an inner assembly but also the inner assembly can be assembled and the cover can be mounted on the inner assembly by the mere pushing in one direction and it has great advantages in that this prior art like the above-noted U.S. Pat. Nos. 4,911,361, 4,940,186 and 4,953,791 can be applied to a large variety of the custom designs of the covers and this construction allows for easy assembly of the pump dispenser.

In the pump dispenser of the general type, a cylinder is integrally formed with a cover and is disposed generally horizontally so that a piston cooperating with the traction of a trigger can reciprocate in the horizontal cylinder. In other words, the piston reciprocates in the horizontal direction. On the contrary, the pump dispenser according to each of U.S. Pat. Nos. 4,911,361, 4,940,186 and 4,953,791 all patented to Atsushi Tada has a vertical cylinder which is reciprocated vertically in cooperation with the angular movement of the trigger. In the pump dispenser according to U.S. Pat. No. 5,156,304 patented to Piero Battegazzore, a cylinder is provided vertically and a piston is housed in the cylinder so that the piston is reciprocated vertically in cooperation with the angular movement of the trigger.

In the pump dispensers of the above-mentioned United States Patents, the angular movement of the trigger is converted into a vertical reciprocating movement of either the cylinder (in the case disclosed in U.S. Pat. Nos. 4,911,361, 4,940,186 and 4,953,791) or the piston (in the case of U.S. Pat. No. 5,156,304). These vertical conversion systems are greatly different from the conventional conversion system for converting the angular movement of the trigger into the horizontal movement of the piston. This difference of the conversion according to the above-mentioned United States Patents gives the users a strange feeling when they use the pump dispenser disclosed in any one of the above-noted United States Patents.

In the pump dispenser according to any one of U.S. Pat. Nos. 4,911,361, 4,940,186 and 4,953,791 in which the cylinder reciprocates vertically, the lower end portion of the cylinder slidably contacts the inner portion of the sealing collar. When this pump dispenser is used in a standing state, no problem occurs. When, on the other hand, it is used in a laid-down state, the lower end portion of the cylinder and the sealing collar are soaked with the liquid, and the liquid leaks out from between the lower end portion of the movable cylinder and the fixed sealing collar, making it difficult to ensure liquid tightness.

In the pump dispenser according to U.S. Pat. No. 5,156,304 which reciprocates the piston vertically, on the other hand, the mechanism for converting the angular movement of the trigger to the vertical movement of the piston is apt to be complicated. Further, the flow-out mount of the liquid per unit stroke cannot be set large because the stroke of the piston cannot be made large.

In contrast, the normal pump dispenser which reciprocates the piston horizontally in cooperation with the trigger has no problem with the liquid tightness. Further, this pump dispenser does not require to make complicated the mechanism for converting the angular movement of the trigger to the horizontal movement of the piston and it is not difficult to set the flow-out rate of the liquid to a large amount. The ordinary pump dispenser is not suitably constructed so that the structural elements other than the cover are unitarily formed and are covered with the cover, although such a unitary structure is required.

SUMMARY OF THE INVENTION

It is an object of this invention to provide a pump dispenser to which is applied any one of covers having a great variety of custom designs although the pump dispenser has a conventional structure using a piston reciprocating horizontally in cooperation with a trigger.

It is another object of this invention to provide a method of assembling a pump dispenser to which is applicable any one of covers having a variety of custom designs and which are suited for being manufactured in a knockdown way.

The inventors of this invention paid attention to the fact that it is difficult to assemble a bottle cap and a packing into an inner assembly of the pump dispenser having a conventional structure in which the bottle cap and the packing are mounted on the lower end of the cover through the inner assembly, and they studied a new system for overcoming the difficulty of the conventional system.

In order to achieve the above-noted objects, this invention uses a structure and a method in which a cover is pushed in at a lateral side of an inner assembly to be mounted thereon under a horizontal pushing force in place of pressing the cover downward, enabling all the structural elements except for the cover to be assembled into a unit.

The cover is fixed to the inner assembly at three portions, for example. In other words, (1) a fitting projection is formed on the upper surface of a nozzle base and a fitting hole for receiving the fitting projection is formed in the upper surface of the ceiling of the cover;

(2) horizontally extending, opposed engaging pieces are provided on the lower end of a cylinder and the upper end of a valve housing, respectively, and a horizontally extending engaging piece is provided so as to be engageable with a space defined between the horizontally extending engaging pieces; and (3) an engaging groove is formed in the upper surface of a nozzle base behind the fitting projection and an engaging projection is formed on the inner surface of the ceiling of the cover so as to be fitted in the engaging groove.

For example, the cover is pushed toward the cover at the opposite side to a trigger, i.e., at the back side (rear side) of the cover under a horizontal pushing force. Then, a horizontal engaging piece formed on the lower end of the cover engages the space defined between the horizontal engaging pieces formed on the lower end of the cylinder and the upper end of the valve housing, respectively, and the horizontally extending engaging groove formed in the upper surface of the nozzle base engages the engaging projection formed on the inner surface of the ceiling of the cover so that the cover is prevented from being moved vertically and from being rotated.

Finally, the fitting projection on the upper surface of the nozzle base is fitted in and received by the fitting hole in the ceiling surface of the cover. After this fitting, the cover cannot be pushed in further or pushed out and the horizontal movement of the cover is also restricted. The vertical and horizontal movements (rotational movement, vertical linear movement and horizontal linear movement) of the cover are prohibited and the cover is firmly fixed to the inner assembly.

By using the method according to this invention in which the cover is pushed in laterally (horizontally), all the structural elements including the bottle cap and the packing (except for the cover) can be previously formed as an inner assembly and the pump dispenser can be assembled merely by pushing the cover toward the inner assembly.

DETAILED DESCRIPTION OF THE PREFERRED EMBODIMENTS

A preferred embodiment of this invention will be described with reference to the accompanying drawings.

Figure 1:
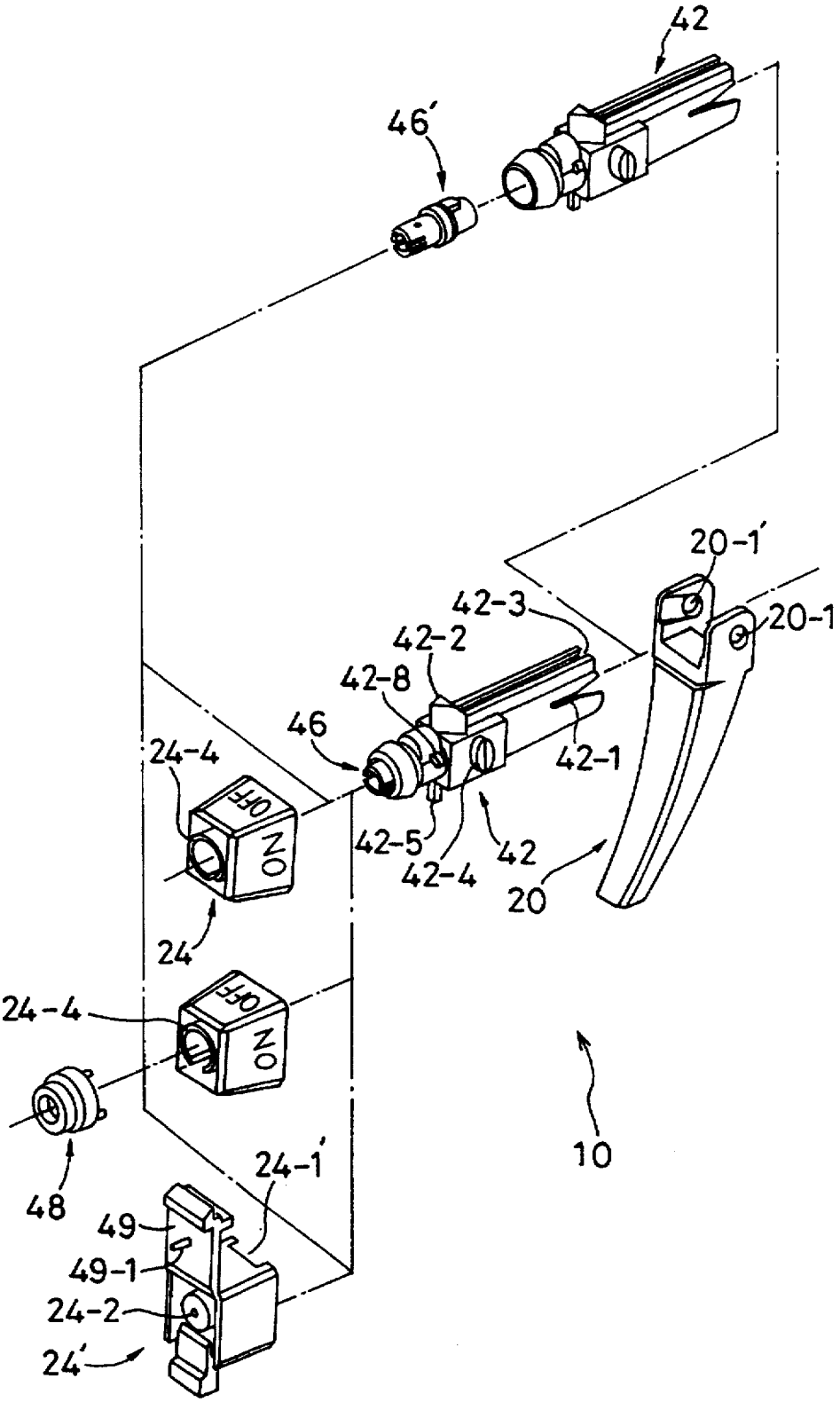
FIG. 1 is an exploded perspective view of the left-side half portion of a pump dispenser according to one embodiment of this invention.
Figure 2:
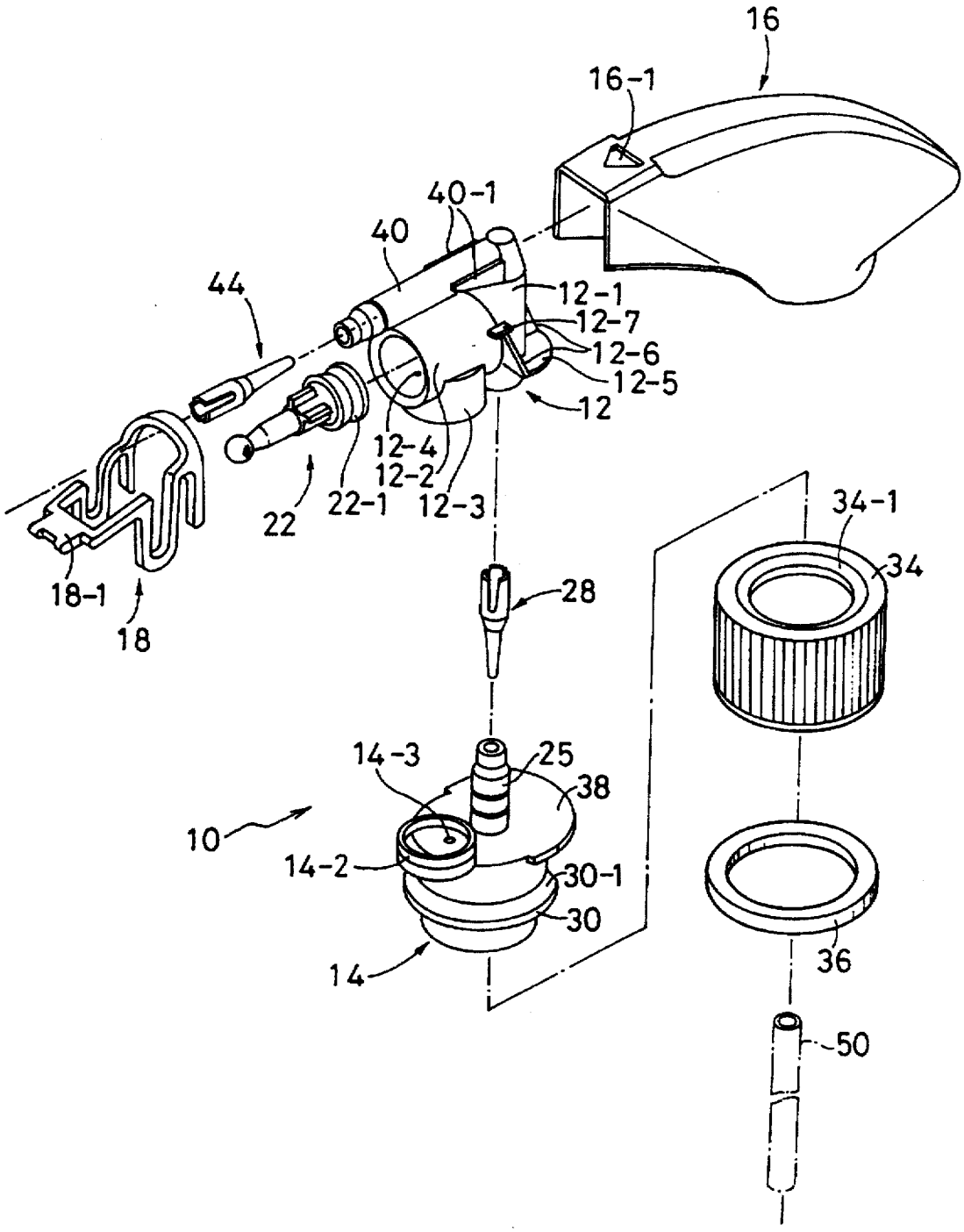
FIG. 2 is an exploded perspective view of the right-side half portion of the pump dispenser according to the embodiment of this invention.
Figure 3:
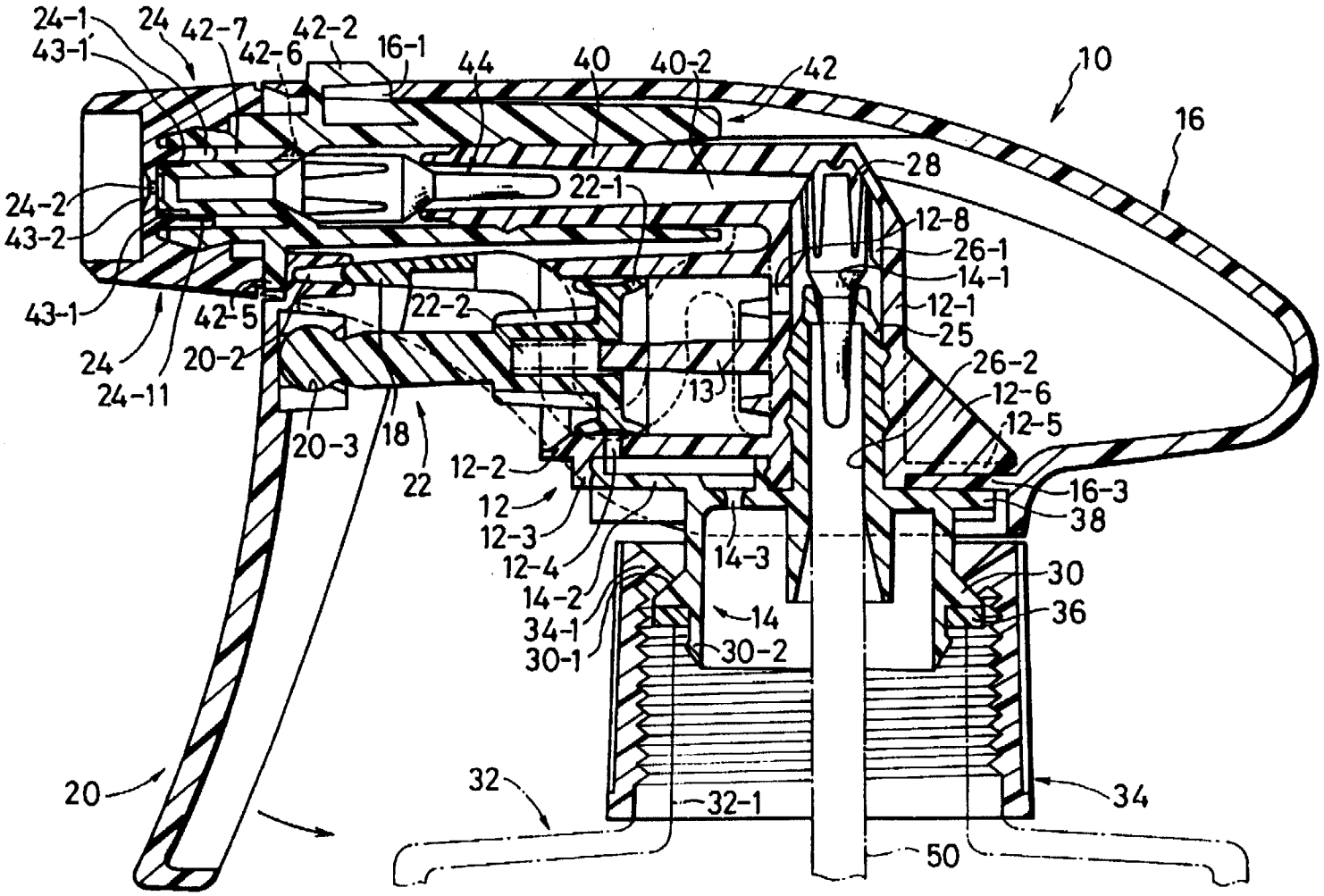
FIG. 3 is a schematic longitudinal cross-sectional view of the pump dispenser at the initial portion of a trigger of the pump dispenser.

Exploded perspective views of a pump dispenser 10 according to one preferred embodiment of this invention are shown in FIGS. 1 and 2 and a schematic perspective view of the pump dispenser 10 is shown in FIG. 3. As shown in FIGS. 1 to 3, the pump dispenser 10 comprises a cylinder 12, a valve housing 14, a cover 16, a return spring 18, a trigger 20, a piston 22 and a nozzle 24, all elements being injection molded from a plastics material.

The cylinder 12 comprises a vertical cylindrical portion 12-1 defining therein a flow-in passageway 26-1 and a horizontally extending cylinder body 12-2 defining therein a pump chamber in which the piston 22 reciprocates. The valve housing 14 is mounted on the vertical cylindrical portion 12-1 from its bottom side. The flow of a liquid into the cylinder body 12-2 is controlled by a primary valve 28.

The valve housing 14 has a cylindrical shape and a columnar portion 25 formed on its upper portion. A flow-in passageway 26-2 is defined in the columnar portion 25. As seen from FIG. 3, a valve seat 14-1 is formed in the upper end of the columnar portion 25 and the primary valve 28 housed in the vertical cylindrical portion 12-1 of the cylinder 12 is pressed against the valve seat 14-1.

Similar to a secondary valve which will be described later, the primary valve 28 has a conical proximal portion and a plurality (three, for example) of blades extending from the proximal portion and is injection molded integrally from a plastic material to form a valve with blades. The primary valve 28 is pressed against the valve seat 14-1 by elastic forces of the blades. When the liquid pressure exceeds the elastic force of the primary valve, the primary valve is released from the valve seat 14-1 to be opened. A valve disclosed in U.S. Pat. No. 4,921,017 can be used as the primary valve 28, for example.

As shown in FIGS. 2 and 3, a flange 30 is formed on the lower end of the valve housing 14. The upper surface 30-1 of the flange 30 is reclined so as to form an inclined surface. A bottle cap 34 for mounting the pump dispenser 10 on the neck portion 32-1 of a container 32 has longitudinal grooves formed in its outer surface and a female thread formed on its inner surface. The proximal portion 34-1 of the open upper surface of the bottle cap 34 is formed so as to be inclined downward.

The bottle cap 34 is pushed into the valve housing 14 from its underside so that the proximal portion 34-1 exceeds the flange 30 of the valve housing 14. The proximal portion 34-1 is engaged with the upper surface 30-1 of the flange 30 of the valve housing 14 and the bottle cap 34 is unremovably mounted on the valve housing.

An annular projection 30-2 is formed on the outer surface of the lower end of the valve housing 14 under the flange 30. A packing 36 is pushed into the valve housing 14 from its underside and exceeds the annular projection 30-2 to be engaged with the annular projection and mounted thereto, thereby preventing the packing 36 from falling.

Figure 4:
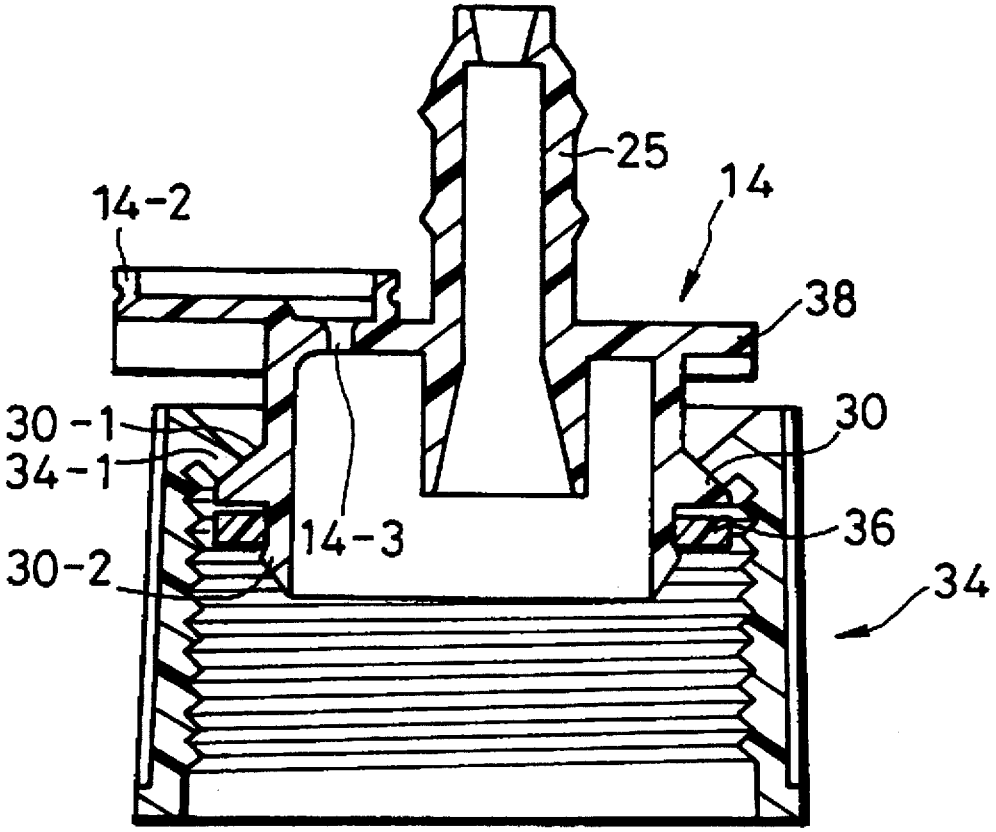
FIG. 4 is a longitudinal cross-sectional view of an assembly formed by assembling together a valve housing, a packing and a bottle cap.

In this way, the bottle cap 34 and the packing 36 are fixedly engaged with the valve housing 14 so as not to fall off. FIG. 4 shows a state in which the bottle cap 34 and the packing 36 are mounted on the valve housing 14.

Figure 5B:
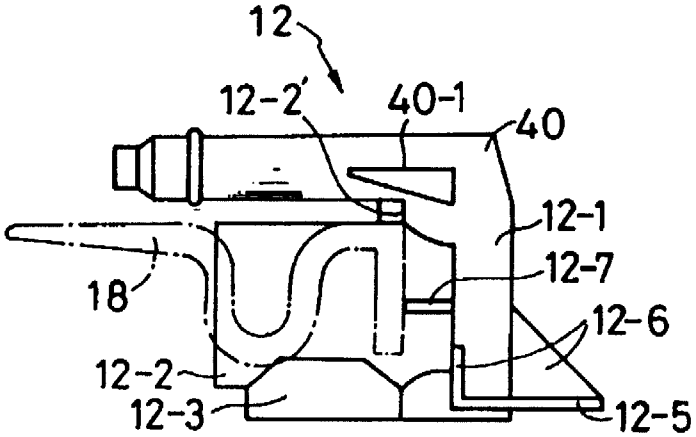
FIG. 5B is a front view of the cylinder.
Figure 5C:
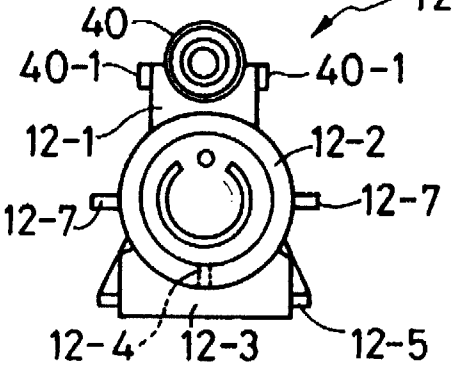
FIG. 5C is a left side view of the cylinder.
Figure 5A:
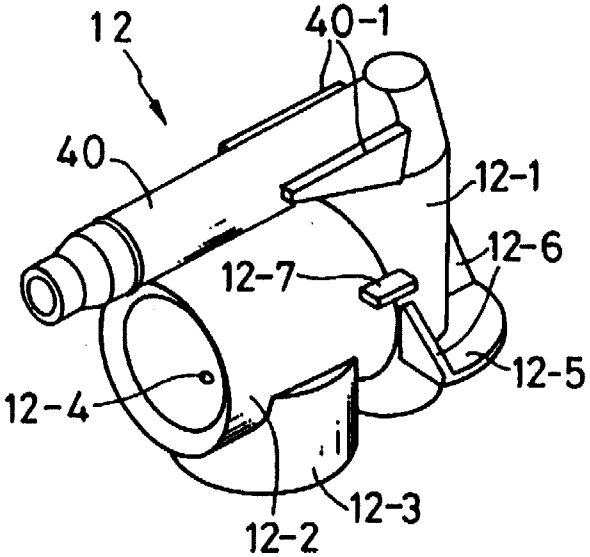
FIG. 5A is a perspective view of a cylinder of the pump dispenser.

As seen from FIG. 5 with reference to FIGS. 2 and 3, the cylinder 12 has another cylindrical portion 12-3 extending downward from a cylinder body (a horizontal cylindrical portion) 12-2 and a vent 12-4 formed in a lateral surface of the cylinder body 12 is opened to the interior of the cylindrical portion 12-3. A corresponding cylindrical portion 14-2 having a small diameter is formed on the front portion of the valve housing 30. The columnar portion 25 of the valve housing 14 is fitted in the vertical cylindrical portion 12-1 and the cylindrical portion 14-2 is fitted in the mounted on the cylinder 12. In other words, the cylindrical portions 12-3 and 14-2 comprises the means for preventing rotation of the valve housing 14.

Another vent 14-3 is formed in the proximal portion of the cylindrical portion 14-2 of the valve housing 14 (see FIG. 4). As the piston 22 is pushed in, the open air flows in the container 32 through the vents 12-4 and 14-3 to prevent the interior of the container 32 from being negatively pressurized.

As seen from FIG. 2, the valve housing 14 is provided on the opposite side to the cylindrical portion 14-2, i.e., on the rear surface (on the right side in FIGS. 1 and 3) with a generally semicircular engaging piece 38 which extends horizontally. A corresponding generally semicircular engaging piece 12-5 which extends horizontally is formed on the rear surface of the cylinder 12 over the engaging piece 38 of the valve housing 14. The engaging piece 12-5 of the cylinder is reinforced by ribs 12-6. When the valve housing 14 is mounted on the cylinder 12, the horizontal engaging piece 12-5 is just disposed over the horizontal engaging piece 38 with a space left therebetween. As will be described later, a horizontal engaging piece 16-3 provided on the lower end of the cover 16 is inserted in the space from the right side in FIG. 3 to prevent the cover 16 from being moved vertically.

As shown in FIGS. 2, 3 and 5, a pair of horizontal stoppers 12-7 are formed on the right and left sides of the cylinder 12. A cylindrical portion 40 constituting a nozzle holder is formed on the top of the vertical portion 12-1 of the cylinder 12 and extends forward (toward the left side in FIG. 3) in parallel with the cylinder body 12-2. A pair of horizontally extending stoppers 40-1 are formed on the right and left sides of the nozzle holder 40.

A communication hole 12-8 is formed in the proximal portion of the cylinder body 12-2. The liquid flows from the container 32 into the cylinder body 12-2 through the flow-in passageway 26-1 and the communication hole 12-8. A flow-out passageway 40-2 is defined in the nozzle holder 40. The liquid pressurized in the cylinder body 12-2 flows from the cylinder body 12-2 into the flow-out passageway 40-2.

A nozzle base 42 is fitted in the nozzle holder 40 from the left side. As shown in FIG. 1, the nozzle base 42 is formed cylindrical so that it can be fitted in the nozzle holder 40 and is made non-rotational by engaging the stoppers 40-1 with a pair of corresponding engaging grooves 42-1 formed in the right and left sides of the rear end (the right end) of the nozzle base 42. In other words, the stoppers 40-1 and the engaging grooves 42-1 function as rotation stopping means of the nozzle base 42 in addition to the positioning means.

Figure 6A:
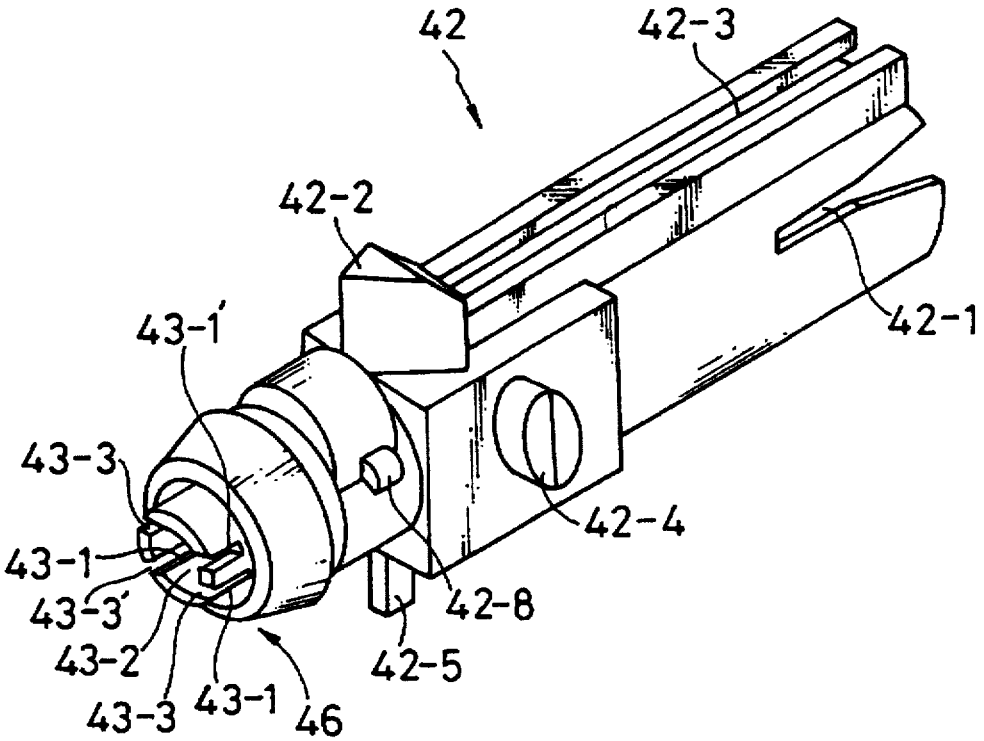
FIG. 6A is a perspective view of a nozzle base of the pump dispenser.
Figure 6B:
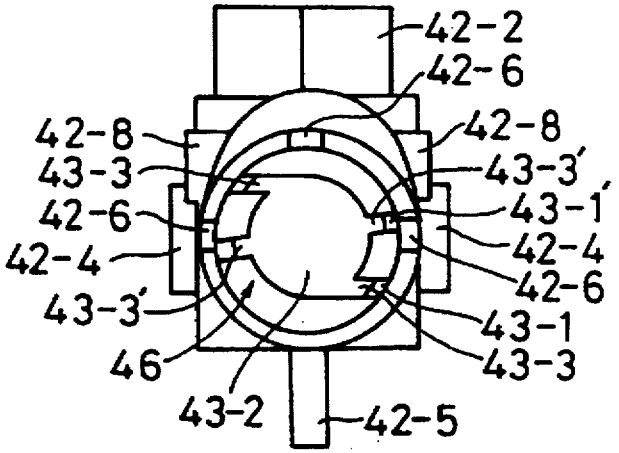
FIG. 6B is a left side view of the nozzle base.
Figure 7C:
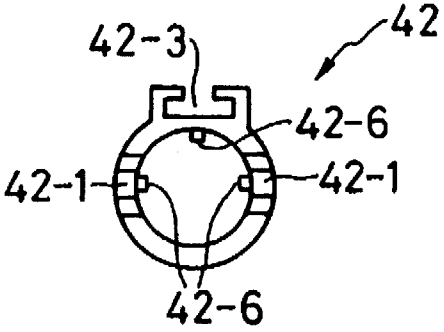
FIG. 7C is a right end view of the nozzle base.
Figure 7A:
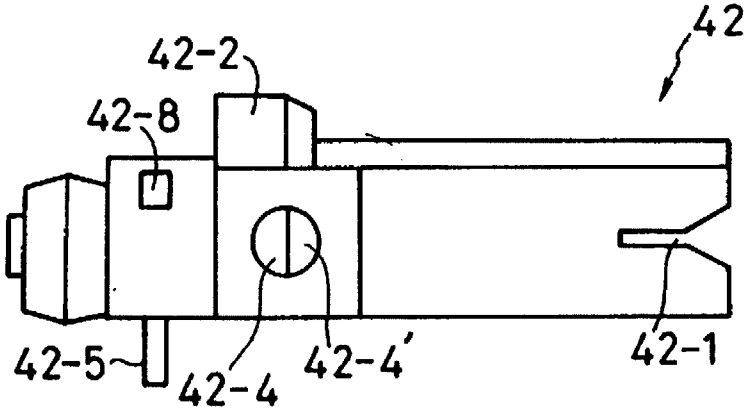
FIG. 7A is a front view of the nozzle base.
Figure 7B:
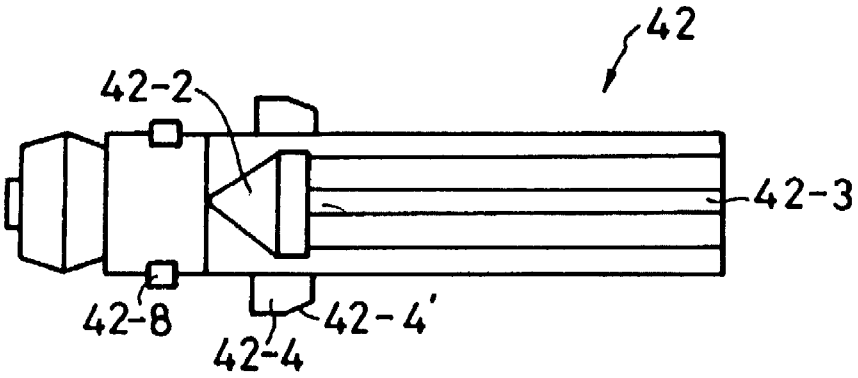
FIG. 7B is a plan view of the nozzle base.

As seen from FIGS. 6 and 7 with reference to FIG. 1, a fitting projection 42-2 is formed on the upper surface of the nozzle base 42. An engaging groove 42-3 is formed in the upper surface of the nozzle base 42 so as to extend from a portion of the nozzle base 42 just behind the fitting projection 42-2 to the right end (the rear end) of the nozzle base. In this embodiment, the fitting projection 42-2 is a generally triangular element with its apex directed leftward (forward) (see FIG. 6A and 7B), and the engaging groove 42-3 has an inverse T-shape, in cross section, opening not only rightward but also upward (see FIG. 7C).

A pair of supporting shafts 42-4 are formed on both lateral sides of the nozzle base 42 and are fitted in engaging holes 20-1 formed in the upper end of the trigger 20 in such a way that the trigger is swingably mounted on the nozzle base. As seen from FIGS. 1 and 8, the trigger 20 has a generally U-shaped cross section and its upper end is cut away so as to be deformed elastically. In this embodiment, the rear half portion 42-4' (the right half portion in FIGS. 7A and 7B) of each supporting shaft 42-4 and the inner surface 20-1' of the upper portion of the trigger 20 in front of each engaging hole 20-1 form an inclined surface or a guide surface (see FIGS. 7A, 7B and 8A). Thus, when the trigger 20 is pushed in the nozzle base 42 from the right side, the engaging holes 20-1 of the trigger are smoothly fitted on the supporting shafts 42-4 of the nozzle base and the trigger is easily mounted on the nozzle base.

As shown in FIG. 2, the return spring 18 is rejection molded from a plastics material into a saddle shaped plate spring. It is inserted into a space between the cylinder body 12-2 and the nozzle holder 40 so as to ride on the cylinder body 12-2. The return spring 18 is mounted on the cylinder body 12-2 from the left side in FIG. 2 and abuts against the proximal portion 12-2' of the cylinder body 12-2 and two stoppers 12-7 formed on the sides of the cylinder body so as to be set in position.

Figure 8C:
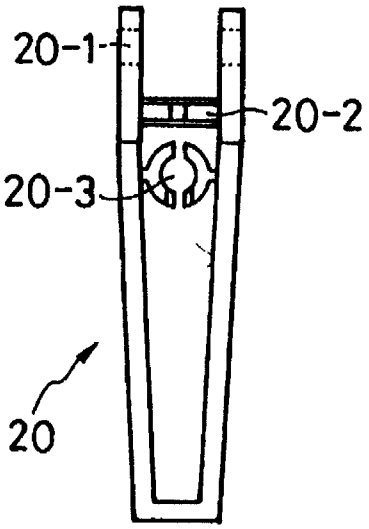
FIG. 8C is a right side view of the trigger.
Figure 8B:
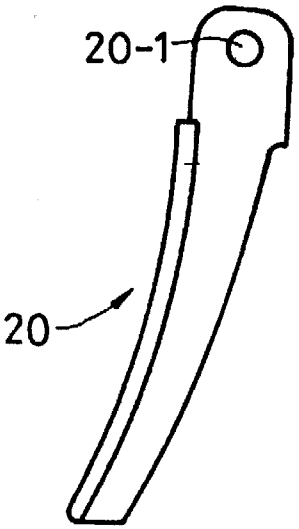
FIG. 8B is a front view of the trigger.
Figure 8A:
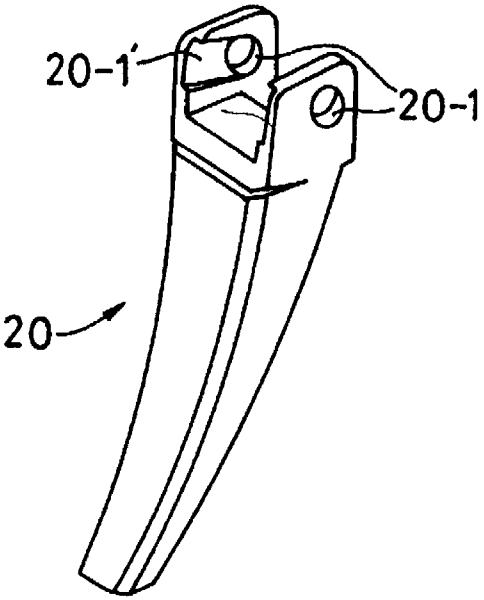
FIG. 8A is a perspective view of a trigger of the pump dispenser.

As seen well in FIG. 2, the return spring 18 is provided on its front end with a flat plate portion 18-1 which engages an engaging groove 20-2 formed in the rear surface of the trigger 20 (see FIGS. 3 and 8C).

The return spring 18 rides on the cylinder body 12-2 and is disposed between the cylinder 12 and the trigger 20 in such a way that the trigger is pushed leftward in FIG. 3 so as to swing the trigger around the supporting shafts 42-4 as swing pivots. As shown in FIGS. 1 and 6A, a stopper 42-5 is formed on the undersurface of the nozzle base 42. The trigger 20 is pressed against the stopper 42-5 and maintained at its initial position (the outside position) by the biasing force of the return spring 18.

Referring to FIG. 3, a secondary valve 44 for controlling flow of the liquid from the cylinder body 12-2 is provided between the nozzle holder 40 and the nozzle base 42. The secondary valve 44 is a valve with blades like the primary valve 28.

As seen from FIG. 3, the front half portion (the left half portion) of the nozzle base 42 comprises double cylinders. Means for producing spins or a spinner 46 is provided on the front end of the blind ended inner cylinder. As shown in FIGS. 1, 3 and 6, the spinner 46 has a pair of axial flow passageways 43-1 formed in the front end of the outer surface of the inner cylinder, a depressed circular portion 43-2 formed in the front face of the bottom portion of the inner cylinder and a pair of flow passageways 43-3 extending tangentially from the depressed circular portion and communicating with the axially extending flow passageway, respectively. The flow passageways 43-1 and 43-3 form flow paths for spray.

Since the front half portion (the left half portion) of the nozzle base 42 has the double cylindrical structure, a space 42-7 is defined between two cylinders, and this space communicates with the interior of the rear half portion (the right half portion) of the nozzle base 42 through communication holes 42-6.

As shown in FIG. 6, in this embodiment the spinner 46 further comprises jet flow paths including a pair of other axial flow passageways 43-1' formed in the front end of the outer surface of the inner cylinder and a pair of radial flow passageways 43-3' communicating with the flow passageways 43-1' and directed toward the center of the depressed circular portion 43-2.

The spinner may be formed as an independent member and may be constructed such that the independent member 46' is housed in the front end of the nozzle base 42 as separately shown at the upper part in FIG. 1.

The nozzle 24 is rotatably fitted in the front end of the nozzle base 42. As shown in FIGS. 1 and 9A to 9C, the nozzle 24 has a bottom and has a square shape, for example, and a cylindrical portion 24-1 extending from the bottom portion toward the rear face is loosely fitted in a space 42-7 formed in the nozzle base 42. Thus, the nozzle 24 is rotatably mounted on the nozzle base 42.

A pair of axial flow passageways 24-11 and a pair of axial flow passageways 24-11' corresponding to the spray flow paths and the jet flow paths, respectively, of the spinner 46 of the nozzle base 42 are formed in the rear end of the inner surface of the cylindrical portion 24-1 of the nozzle 24. When, as shown in FIG. 3, the nozzle 24 is rotated to a position in which the axial flow passageways 24-11 of the nozzle 24 and the flow passageways 43-1 of the nozzle base 42 are aligned and communicate with each other, the remaining axial flow passageways 24-1' are covered with the inner surface of the cylindrical portion 24-1 and the communication between the flow passageways 24-1' and the space 42-7 of the nozzle 24 is interrupted. Thus, the pressurized liquid from the cylinder body 20-2 flows from the communication hole 42-6 into the space 42-7 and then from the tangential flow passageway 43-3 into the depressed circular portion 43-2 in the front end of the nozzle base 42 through the axial flow passageways 24-11 and 43-1. Finally, the pressurized liquid is swirled and flows out as a spray from an orifice 24-2 formed in the center of the bottom of the nozzle 24.

When, on the other hand, the nozzle 24 is rotated to a position in which the axial flow passageways 24-11' of the nozzle 24 and the axial flow passageways 43-1' of the nozzle base 42 are aligned and communicate with each other, the remaining flow passageways 43-1 are covered with the inner surface of the cylinder portion 24-1 and the communication between the flow passageways 43-1 and the space 42-7 of the nozzle 24 is interrupted. As a result, the pressurized liquid from the cylinder 12 flows from the space 42-7 to the depressed circular portion 43-2 through the axial flow passageways 24-11' and 43-1'. In this state, the pressurized liquid is not swirled but flows out as a jet from the orifice 24-2.

It follows that the positions in which the axial flow passageways 24-11 and 24-11' formed in the nozzle 24 are aligned with the axial flow passageways 43-1 and 43-1' formed in the nozzle base 42, respectively, are the "ON" position of the nozzle 24. There are two "ON" positions. As described above, a spray flow is produced when the tangential flow passageways 43-3 of the nozzle base 42 communicate with the axial flow passageways of the nozzle base 24, respectively, and a jet flow is obtained when the radial flow passageways 43-3' communicate with the axial flow passageways of the nozzle base and the nozzle.

At positions in which the axial flow passageways 24-11 and 24-11' are not aligned with the axial flow passageways 43-1 and 43-1', both flow passageways 43-1 and 43-1' are covered with the inner surface of the cylindrical portion 24-1 and the communication between the flow passageways 43-1 and 43-1' and the space 42-7 of the nozzle 24 is interrupted, whereby the "OFF" positions in which the pressurized liquid does not flow out are set.

Every time the nozzle 24 rotates through 90°, the nozzle 24 takes one of the "ON" positions, one of the "OFF" positions, another "ON" position and another "OFF" position in return. Since indications "ON" and "OFF" are marked on the corresponding four sides of the nozzle 24, the position of the nozzle can be confirmed at a glance (see FIG. 9A). In this embodiment, the position in which spray flow is produced is shown by "ON", whereas the position in which the jet flow is obtained is indicated by "JET" instead of "ON".

Figure 9C:
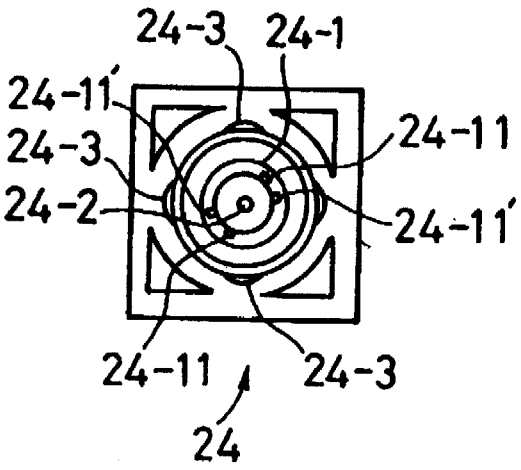
FIG. 9C is a right side view of the nozzle.
Figure 9B:
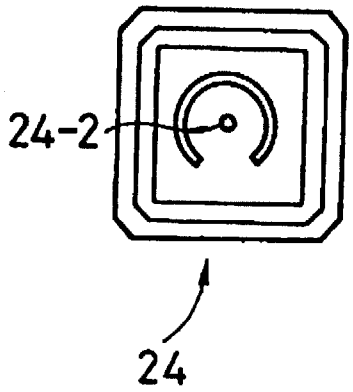
FIG. 9B is a left side view of the nozzle.
Figure 9A:
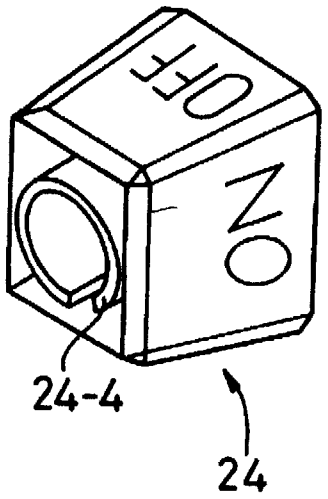
FIG. 9A is a perspective view of a nozzle of the pump dispenser.

As seen from FIG. 9C showing the rear view of the nozzle 24, the four engaging grooves 24-3 separated by 90° from each other are formed in the rear face of the nozzle 24 and two corresponding engaging projections 42-8 are formed on the lateral surfaces of the nozzle base 42 so as to be separated by 180° from each other.

In this structure, the rotational positions of the nozzle 42 separated by 90° from each other are determined by the engagement of the engaging projection 42-8 of the nozzle base 42 with the engaging groove 24-3 of the nozzle 24, and the engagement projections 42-8 and the engaging grooves 24-3 constitute positioning means.

In this embodiment, the engaging projections 42-8 are formed on the nozzle base 42 and the engaging grooves 24-3 are formed in the nozzle 24. However, the arrangement of these elements is not limited thereto. For example, contrary to the arrangement of this embodiment, the engaging projections 42-8 may be formed on the nozzle 24 and the engaging grooves 24-3 may be formed in the nozzle base 42. Further, the number of the engaging projections 42-8 is not limited to two but may be one or four. The positioning means may comprise a combination of the elements other than the combination of the engaging projections 42-8 and the engaging grooves 24-3.

In front of the orifice 24-2 of the nozzle 24 may be provided foaming means such as a wall, a net or such as sponge against which the spray flow collides. When the foaming means 48 as an independent element is fitted on the cylindrical portion 24-4 as shown in FIG. 1, the pump dispenser 10 can be used as a foaming device. When a part of the cylindrical portion 24-4 of the front face of the nozzle 24 is cut away, the cutaway forms an intake of the open air. Since the cutaway provides elasticity, the foaming means 48 can be easily fitted. For example, the foaming means 48 can comprise a Y-shaped wall against which the spray flow collides.

The nozzle which is indicated by 24' may comprise a hinge cover 49, an orifice 24-2 having the front face covered with the hinge cover and a projection 49-1 formed on the rear face of the hinge cover for sealing the orifice 24-2 and preventing the flow-out of the liquid forcibly so that the nozzle may be engaged with the nozzle base 42. The nozzle 24' is similar to one of the prior art nozzle such as a nozzle with a hinge as disclosed in Examined Japanese Patent Application Publication No. 57-032626. However, the nozzle 24' is different from the prior art in that a cutaway 24-1 is formed in the rear face of the nozzle 24' and the hinge cover 49 is made engageable with the cutaway.

On the rear end of the outer surface of the piston 22 is formed skirt-shaped seal pieces 22-1 which are in a slidable contact with the inner surface of the cylinder body 12-2. As shown in FIG. 2 and 3, two seal pieces are provided in tandem. As shown in FIG. 3, the vent 12-4 of the cylinder 12 is disposed between the tandem arranged two seal pieces 22-1 at the initial position of the trigger 20. i.e., at the initial position of the piston 22. Thus, the liquid is prevented from leaking from the container 32 through the vent 12-4.

Since the swing of the trigger 20 around the swing pivots (the supporting shafts 42-4) is converted into the horizontal reciprocating movements of the piston 22, it is essentially impossible to convert the swing movement to accurate linear reciprocating movements. The piston 22 cannot make accurate horizontal movements but waves upward and downward during the reciprocating movements. Therefore, leakage of the liquid is apt to occur. With the two seal pieces 22-1 arranged so as to be separated longitudinally, however, the upward and downward waving is suppressed by them.

As shown in FIG. 3, the front end of the piston 22 has a spherical shape and is pivoted on a spherical receiving portion 20-3 formed in the rear surface of the trigger 20 (see FIG. 8C). The pivotal mounting of the spherical elements mating with each other allows the swing of the trigger 20 to be converted into accurate horizontal reciprocating movements without fail.

As seen from FIG. 3, the rear half portion (the right half portion) of the piston 22 is a hollow body having a depression 22-2, and the guide rod 13 extends from the proximal portion of the cylinder body 12-2 and is loosely fitted in the depressed portion 22-2. A skirt-shaped seal piece may be formed on the rear end of the piston and may be in slidable contact with the guide rod 13. Further a vent for allowing the depressed portion 22-2 to communicate with the open air may be formed in the piston 22.

As shown by one-dot chain lines in FIG. 3, the front end of the guide rod 13 is pressed against the proximal end of the depressed portion 22-2. This pressing limits the pushing-in of the piston 22. In other words, the guide rod 13 and the depressed portion 22-2 function as stoppers for the piston 20. The amount of flow-out of the liquid per unit stroke is determined by the push-in position of the piston 22, i.e., the stroke of the piston. Thus, the amount of low-out per unit stroke is adjusted by merely changing the length of the guide rod 13. Therefore, pump dispensers 10 providing different amount of flow-out of the liquid can be obtained by merely changing the lengths of the guide rods 13 of the cylinders 12 and by using other common structural elements.

The piston 22 reciprocates with the two seal pieces 22-1 made a slidable contact with the inner surface of the cylinder 12 so that the upward and downward waving of the piston 22 is limited. Further, the engagement of the mating spherical members allows the swing of the trigger 20 to be smoothly converted into the horizontal movements of the piston 22, therefore it prevent the piston from waving during its reciprocating movements.

As shown in FIGS. 2 and 10A to 10E, the cover 16 is opened at its front end and its bottom and includes a ceiling and lateral portions suspended from both sides of the ceiling so that the ceiling and the lateral portions define a hollow structure having a generally inverse U-shaped cross section. A fitting hole 16-1 is formed in the front end portion of the surface of the ceiling and has generally triangular shape capable of being fitted in the fitting projection 42-2 formed on the upper surface of the nozzle base 42 (see FIG. 6). The movements of the cover 16 in the forward and rearward directions (in the rightward and leftward directions in FIG. 3) are prevented by engaging the fitting projection 42-2 on the upper surface of the nozzle base 42 with the fitting hole 16-1 of the cover 16. As will be described later, the cover 16 is pushed from the right side in FIG. 3 and the surface of the ceiling of the cover slides on the upper surface of the nozzle base 42 in this embodiment. Then, the fitting projection 42-2 of the nozzle base 42 is fitted in the fitting hole 16-1 of the cover, whereby the cover 16 is securely mounted on the nozzle base 42.

In this embodiment, the fitting hole 16-1 of the cover 16 and the fitting projection 42-2 of the nozzle base 42 have a generally triangular shape. However, their shape is not limited thereto but may be any shape as long as they can moved in the vertical directions and fitted together in order to prevent the rightward and leftward movements of the cover 16. When, however, the fitting hole 16-1 of the cover 16 and the fitting projection 42-2 of the nozzle base 42 have a general triangular shape, they have the advantage of functioning as an index showing the rotational positions of the nozzle 24, i.e., the indications (ON, OFF and JET) on the upper surface of the nozzle.

Figure 10A:
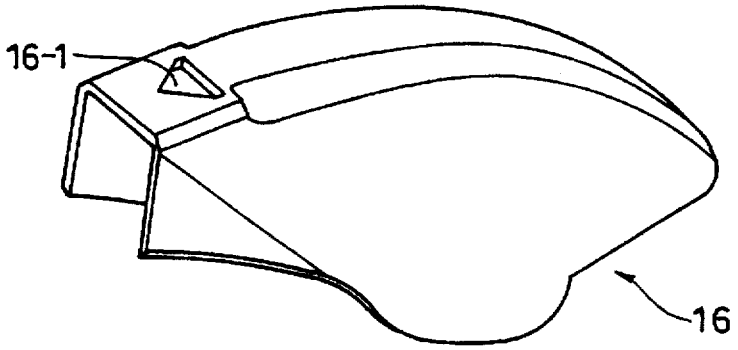
FIG. 10A is a perspective view of a cover of the pump dispenser.
Figure 10E:
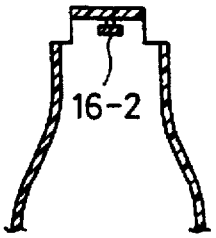
FIG. 10E is a cross-sectional view taken along the line E—E in FIG. 10B.
Figure 10B:
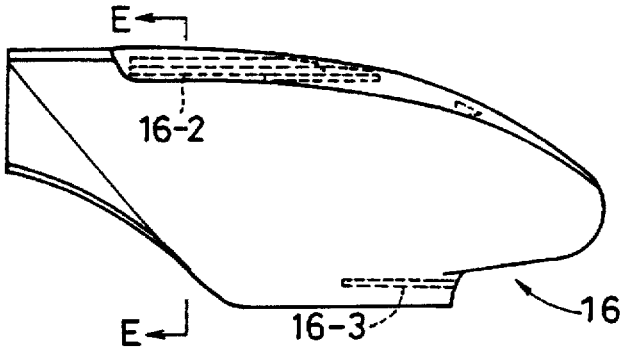
FIG. 10B is a front view of the cover.
Figure 10C:
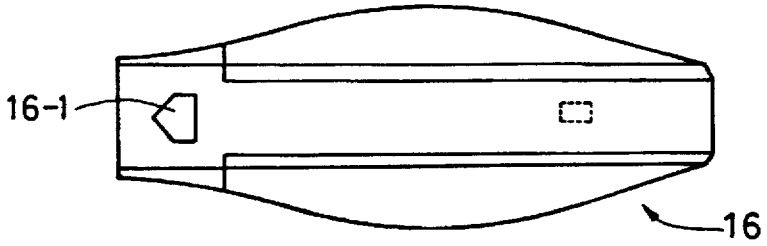
FIG. 10C is a plan view of the cover.
Figure 10D:
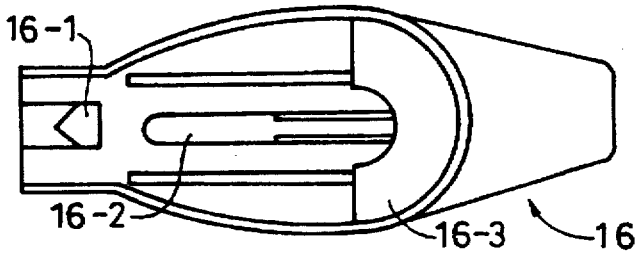
FIG. 10D is a bottom view of the cover.

As shown in FIGS. 10B, 10D and 10E, and engaging projection 16-2 having a generally inverse U-shaped cross section which is engageable with the engaging groove 42-3 on the upper surface of the nozzle base 42 from the rear face of the nozzle base (from the right side in FIG. 7A) is formed on the inner surface of the ceiling so as to extend longitudinally (in the rightward and leftward directions in FIG. 10B). As seen from FIGS. 10B and 10D, the horizontal engaging piece 16-3 having a generally semicircular shape is formed on the inner surface of the rear end of the lower portion of the cover 16 and has such a size that it can be engageably inserted in the space defined between the generally semicircular engaging piece 12-5 of the cylinder 12 and the generally semicircular engaging piece 38 of the valve housing 14.

As described above, the pump dispenser 10 is constructed in such a way that the structural elements except for the cover 16 are assembled together independently of the cover to form a unit. The assembling, although it is an example and is not limited thereto, can be performed in the following way.

Figure 11:
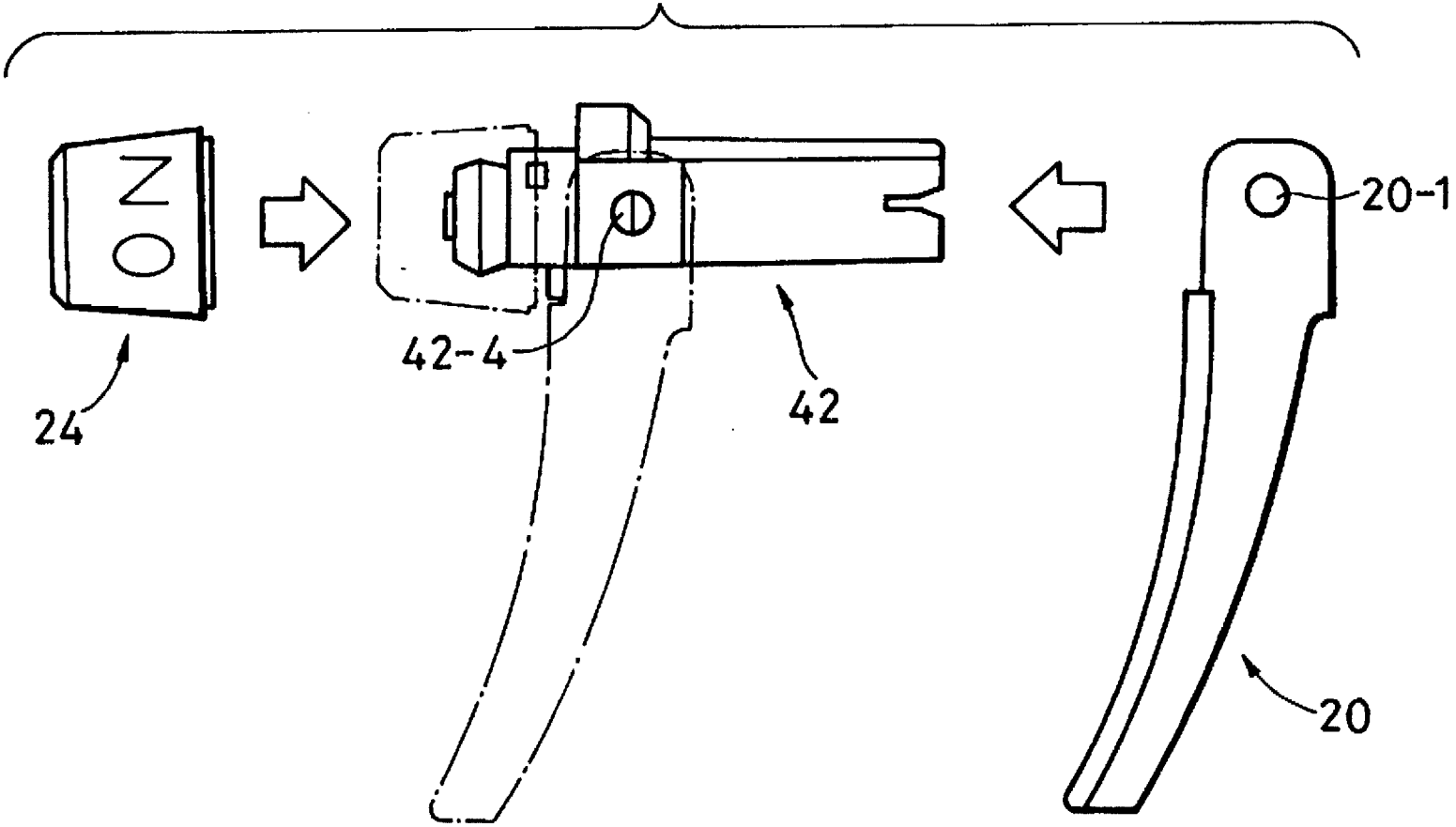
FIG. 11 shows a process of assembling the nozzle and the trigger to the nozzle base.

As shown in FIG. 11, the nozzle 24 is disposed in front of the nozzle base 42 (at the left side in FIG. 11 ) with the cylindrical portion 24-1 on the rear face of the nozzle 24 (see FIG. 9C) aligned with the front end of the nozzle base. The trigger 20 is disposed at the right side of the nozzle base 42 in FIG. 11 with the engaging holes 20-1 in the upper end of the trigger with the supporting shafts 42-4 in the lateral sides of the nozzle base 42. Pushing forces are applied to the nozzle 24, the nozzle base 42 and the trigger 20 in horizontal direction so that they are assembled together. For example, the nozzle 24 is pushed rightward toward the nozzle base 42 and the trigger 20 is pushed leftward toward the nozzle base 42.

Then, the cylindrical portion 24-1 of the nozzle 24 is engaged with the front end of the nozzle 24 and the engaging hole 20-1 of the trigger 20 is pivotally engaged with the supporting shafts 42-4 of the nozzle base 42. As a result, the nozzle 24 and the trigger 42 are mounted on the nozzle base 42, and the trigger, the nozzle and the nozzle base are assembled together as a unit as shown by a one-dot chain line in FIG. 11.

Figure 12:
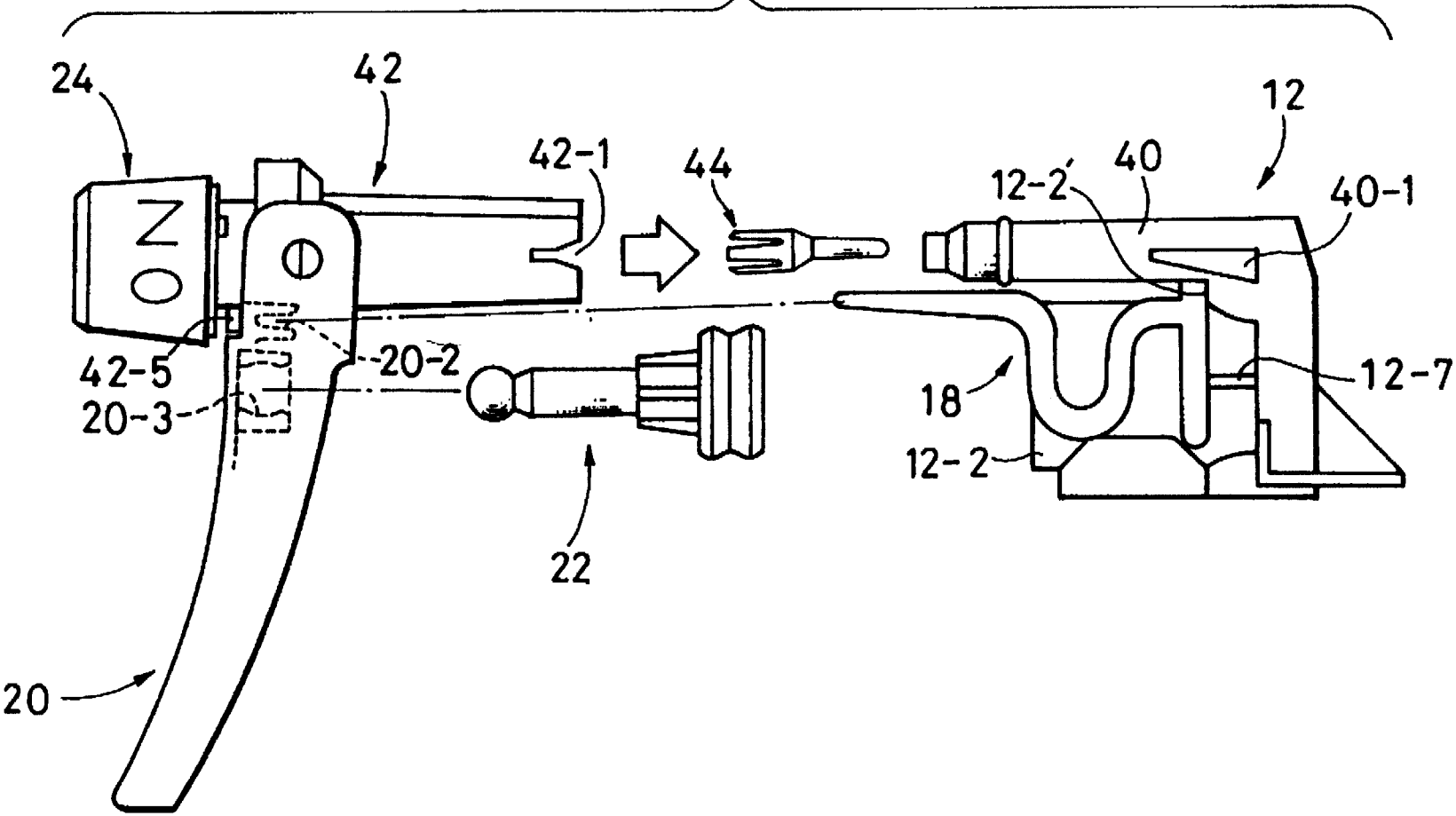
FIG. 12 shows a process of assembling a return spring, a piston, a secondary valve and an assembly comprising the nozzle, the nozzle base and the trigger to a cylinder.

The nozzle base 42 together with the nozzle 24 and the trigger 20 is mounted on the cylinder 12. In order to do so, as shown in FIG. 12, the return spring 18 is placed on the cylinder 12 so as to ride on the cylinder body 12-2. The nozzle base 42 is aligned with the nozzle holder 40 of the cylinder 12 and disposed at the left side of the cylinder with the secondary valve 44 interposed therebetween, and the piston 22 is disposed between the cylinder body 12-2 and the trigger 20 with the spherical portion of the front end of the piston aligned with the spherical receiving portion 20-3 of the trigger 20.

Horizontal pushing forces are applied to the nozzle base 42 and the cylinder 12 toward each other. For example, as the nozzle base 42 is pushed from the left side toward the nozzle holder 40, the secondary valve 44 is pushed in the nozzle base 42 and the piston 22 is pushed in the cylinder 12. The nozzle base 42 is pushed toward the cylinder 12 with the flat plate portion 18-1 of the front end of the return spring 18 aligned with the engaging groove 20-2 of the rear face of the trigger 20.

The nozzle base 42 is pushed rightward to be mounted on the cylinder 12 until the engaging grooves 42-1 in the lateral sides of the nozzle base 42 engage the stoppers 40-1 on the lateral sides of the nozzle holder 40 and the nozzle base 42 cannot be pushed further. The nozzle base 42 is non rotationally connected to the cylinder 12 by engaging the stoppers 40-1 with the engaging grooves 42-1.

When the nozzle base 42 is mounted on the cylinder 12, the flat plate portion 18-1 of the return spring 18 engages the engaging groove 20-2 of the rear surface of the trigger 20. The rear end of the return spring 18 is pressed against the stoppers 12-7 on the lateral sides of the cylinder 12 and the proximal portion 12-2' of the cylinder body 12-2. The return spring 18 is placed between the cylinder 12 and the trigger 20 and pushes the trigger 20 leftward. The trigger 20 is retained at the initial position in which the trigger is pressed against the stopper 42-5 formed on the undersurface of the nozzle base 42.

Figure 13:
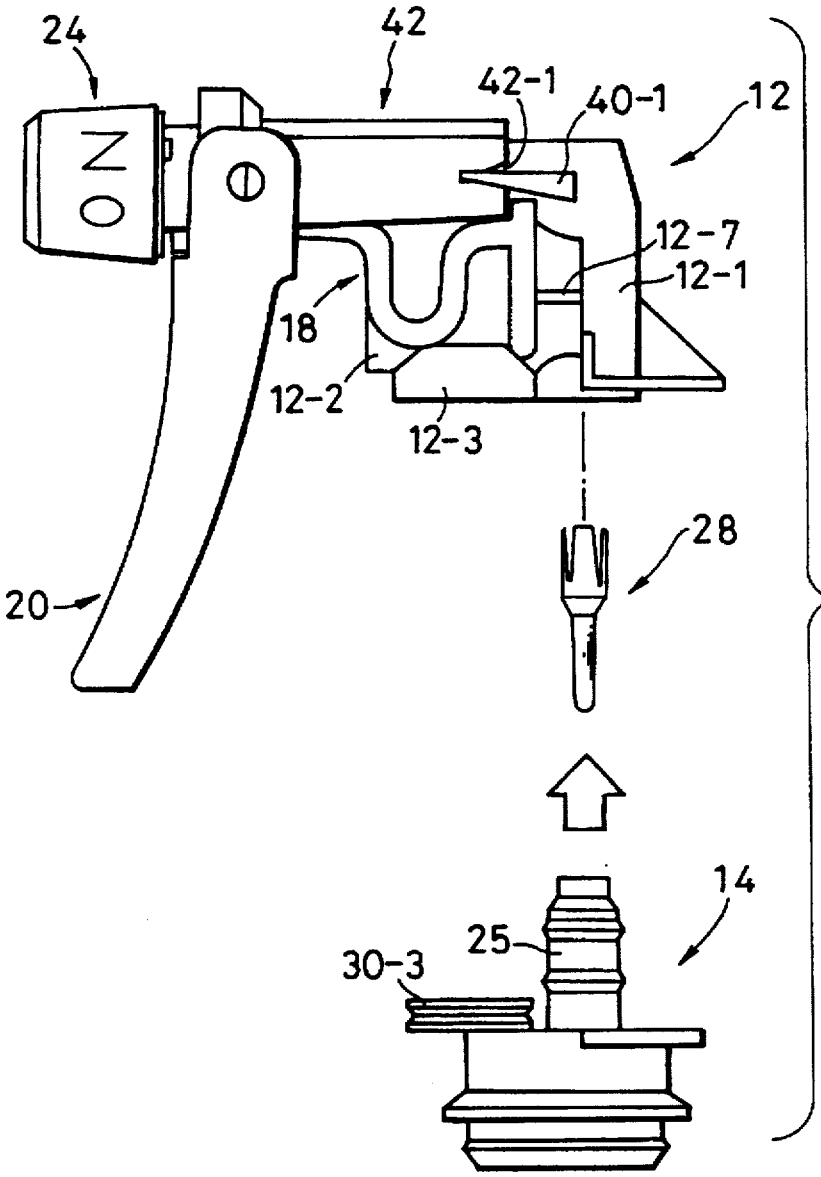
FIG. 13 shows a process of assembling the valve housing and a primary valve to the cylinder having the nozzle base and the others assembled thereto.

As shown in FIG. 13, the columnar portion 25 of the valve housing 14 is aligned to the vertical cylindrical portion 12-1 of the cylinder 12 and the cylindrical portion 14-2 of the valve housing 14 is arranged with the cylindrical portion 12-3 of the cylinder to provide the valve housing 14 under the cylinder 12. The primary valve 28 is disposed between the valve housing 14 and the cylinder 12 so as to be aligned with the columnar portion 25 and the vertical cylindrical portion 12-1 of the cylinder.

Vertical pushing forces are exerted to the valve housing 14 and the cylinder 12 to approach each other. For example, the valve housing 14 is pushed in the cylinder 12 from the lower side of the cylinder. Then, the primary valve 28 is housed in the columnar portion 25 of the valve housing 14. Then, the valve housing 42 is connected to the cylinder 12 in a state in which the columnar portion 25 of the valve housing 14 is engaged with the vertical cylindrical portion 12-1 of the cylinder 12 and the cylindrical portion 14-2 of the valve housing 14 is engaged with the cylindrical portion 12-3 of the cylinder 12.

Since the cylindrical portion 14-2 of the valve housing 14 engages the cylindrical portion 12-3 of the cylinder 12 as well as the columnar portion 25 of the valve housing 14 engages the cylindrical portion 12-1 of the cylinder 12, the valve housing is non rotationally connected to the cylinder.

Figure 14:
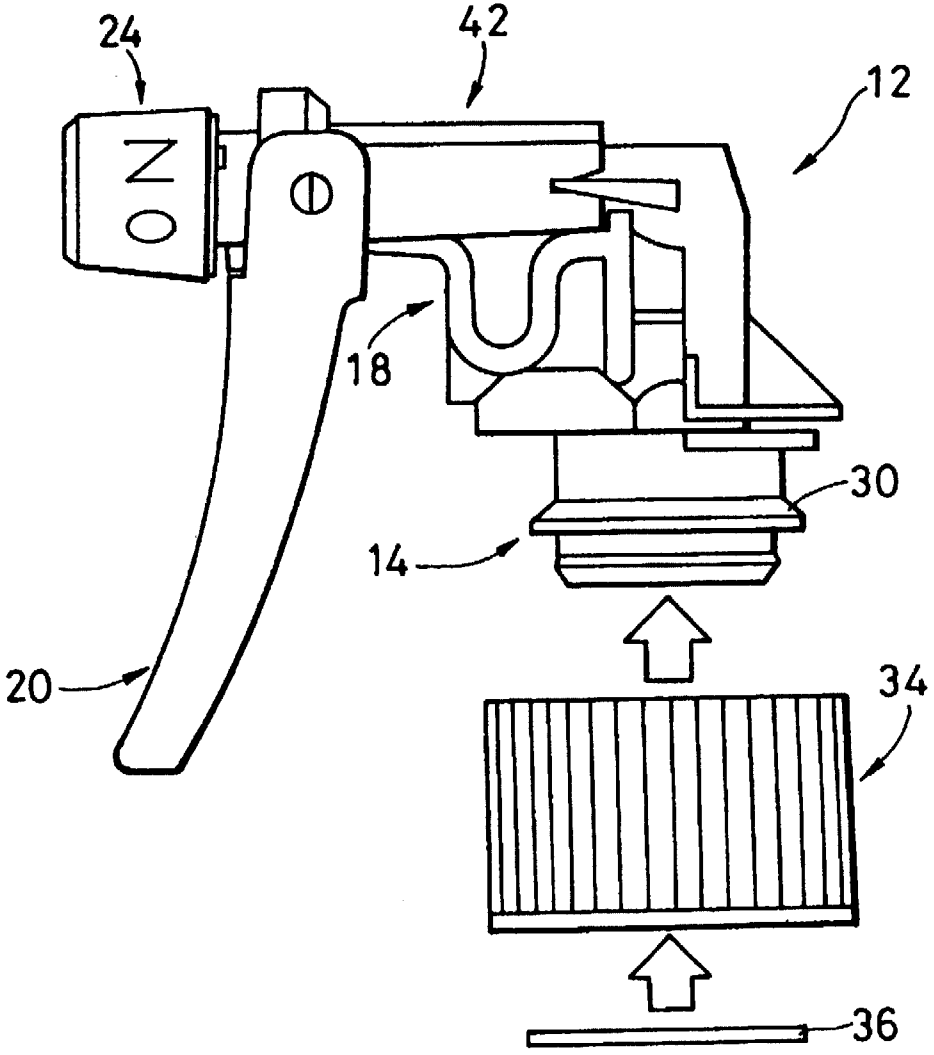
FIG. 14 shows a process of assembling a bottle cap and a packing to the valve housing so as to form an inner assembly.

As shown in FIG. 14, the bottle cap 34 is disposed under the valve housing 14 and the packing 36 is disposed under the bottle cap. Vertical pushing forces are applied to the valve housing 14, the bottle cap 34 and the packing 36 so as to assemble them together. For example, the bottle cap 34 is pushed toward the valve housing 14 from its bottom and is mounted on the valve housing 14 by making the bottle cap 34 engaged with the flange 30 of the valve housing. The packing 36 is pushed against the valve housing 14 from underneath and engages the annular projection 30-2 (see FIG. 3), and thus the packing 36 is mounted on the valve housing 14.

If required after the above steps, a suction 50 which has a length and a diameter according to the detergent distributor is inserted into the cylindrical portion 25 of the valve housing 14 at its lower side (see FIG. 3). However, the suction robe 50 may be inserted to the valve housing 14 by the detergent distributor in consideration of the transportation just before the pump dispenser 10 is connected to the container 32 containing the liquid.

The vertical pushing-in process as shown in FIGS. 13 and 14 may be performed before the horizontal pushing-in process as shown in FIG. 12. In other words, after the housing 14 has been assembled into the cylinder 12, the bottle cap 34 and the packing 36 have been assembled into the valve housing, the nozzle base 42 may be assembled into the cylinder.

The movement of the pump dispenser 10 is substantially the same as that of the prior art. Needless to say, the piston 22 reciprocates in the cylinder 12 in cooperation with the swing of the trigger 20 and the liquid in the container 32 is sucked into the cylinder body 12-2 to be pressurized therein. Then, the pressurize liquid flows out from the orifice 24-2 of the nozzle 24.

In other words, when the operator pulls the trigger 20 toward him or her with a finger being in contact with the front face of the trigger 20, the trigger 20 swings around the swing centers (the supporting shafts 42-4) in the arrow direction against the biasing force of the return spring 18. The piston 22 is pushed into the cylinder body 12-2 in cooperation with the swing of the trigger 20. The guide rod 13 of the cylinder 12 is inserted into the proximal portion of the depressed portion 22-2 of the piston 22 from the initial position shown in FIG. 3 to the position in which the front end of the guide rod 13 abuts against the inner face of the depressed portion 22-2.

After the traction force of the trigger 20 has been removed, the trigger and the piston 22 are pushed out and returned to their initial positions by the biasing force of the spring 18. As described above, the position in which the front face of the trigger 20 presses the stopper 42-5 of the lower surface of the nozzle base 42 is the initial position.

When the piston 22 together with the trigger 20 is returned to its initial position, the interior of the cylinder body 12-2 is negatively pressurized and the primary valve 28 is released from the valve seat 14-1 and opened. On the other hand, the secondary valve 44 is pressed against the valve seat of the front end of the nozzle holder 40 of the cylinder 12 and closed. As the interior of the cylinder body 12-2 is negatively pressurized, the liquid in the container 32 is raised in the suction tube 50, flows into the flow-in passageway 26-1 in the vertical cylindrical portion 12-1 of the cylinder 12 through the primary valve 28 and then flows from the communication hole 12-8 to the cylinder body 12-2.

Thereafter, the trigger 20 is pulled again. The pushing of the piston 22 into the cylinder body 12-2 pressurizes the liquid in the cylinder body. The primary valve 28 is pressed against the valve seat 14-1 and closed and the secondary valves 44 is released from the seat valve and opened. This cause the pressurized liquid to flow from the cylinder body 12-2 to the flow-out passageway 40-2 of the nozzle holder 40 through the communication hole 12-8 and to the nozzle base 42 through the secondary valve 44. The liquid flows through the communication passageway 42-6 in the nozzle holder 40, and then, for example, through the axial passageways 24-11 and 43-1, the tangential passageway 43-3 to the depression 43-2 and is swirled. Finally, the liquid flows out from the orifice 24-2 as a spray flow.

As mentioned above, according to this invention, all the structural elements except for the cover 16 are assembled together as a unit. This unit is hereinafter referred to as an inner assembly 52.

Figure 15:
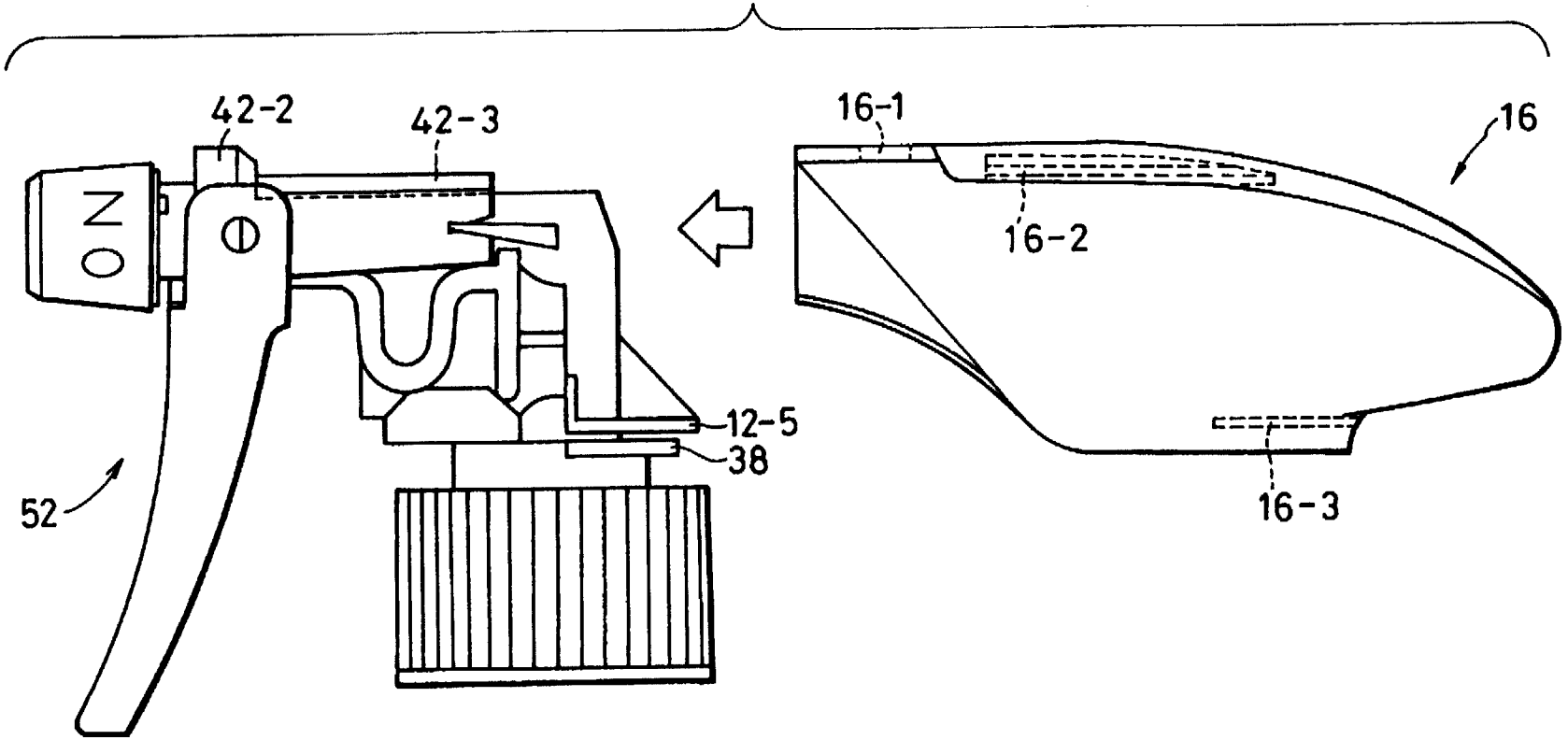
FIG. 15 shows a process of assembling of the cover to an inner assembly.

A horizontal pushing force is applied to the inner assembly 52 or the cover 16 to mount the cover 16 on the inner assembly 52. As shown in FIG. 15, for example, the cover 16 is disposed at the right side of the inner assembly 52 and the cover 16 is pushed toward the inner assembly 52. The engaging piece 16-3 of the cover 16 is aligned with the space defined between the engaging piece 38 of the valve housing 14 and the engaging piece 12-5 of the cylinder 12, and the inverse T-shaped engaging piece 16-2 on the inner surface of the ceiling of the cover 16 is aligned with the corresponding engaging groove 42-3 in the upper surface of the nozzle base 42. Then, the cover 16 is pushed from the right side to the left side.

First, the engaging piece 16-2 of the inner surface of the ceiling of the cover 16 engages the engaging groove 42-3 of the upper surface of the nozzle base 42 from the right side. Then, the engaging piece 16-3 on the inner surface of the lower end of the cover 16 engages the space between the engaging piece 38 and the engaging piece 12-5 from the right side.

The cover 16 is pushed from the right side until the engaging hole 16-1 in the upper surface of the ceiling of the cover comes to the area over the engaging projection 42-2 on the upper surface of the nozzle base 42.

Figure 16:
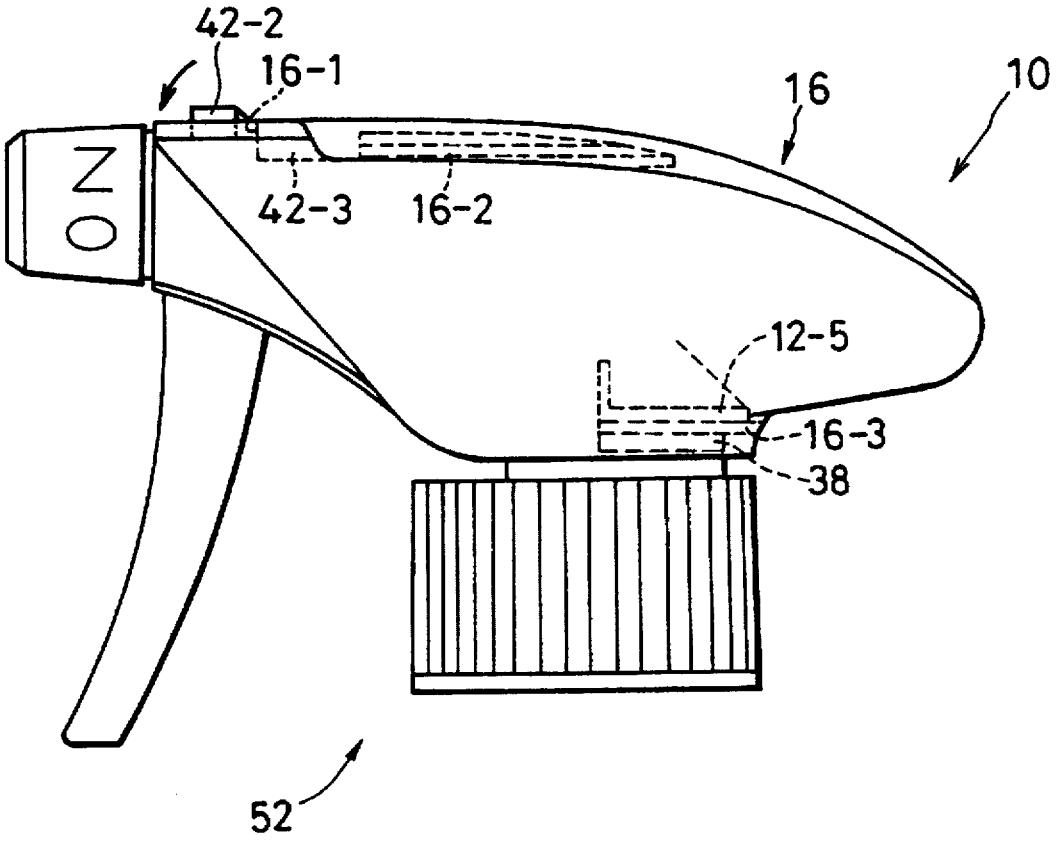
FIG. 16 is a front view of the assembled pump dispenser.

Since the engaging piece 16-2 on the inner surface of the ceiling of the cover 16 has partially engaged the engaging groove 42-3 in the upper surface of the nozzle base 42 and the engaging piece 16-3 on the inner surface of the lower end of the cover 16 has partially engaged the space between the engaging pieces 38 and 12-5 before the fitting hole 16-1 in the upper surface of the ceiling of the cover comes to the area over the fitting projection 42-2 on the upper surface of the nozzle base, the elastic force is applied to the front portion of the cover which is close to the fitting hole 16-1 so as to tend to rotate the cover 16 in the counterclockwise direction as shown by an arrow in FIG. 16. Thus, as soon as the fitting hole 16-1 comes on the area over the fitting projection 42-2, the cover 16 rotates in the direction shown by the arrow and the fitting projection 42-2 is fixedly fitted in the fitting hole 16-1.

When the fitting projection 42-2 is fixedly fitted in the fitting hole 16-1, the engaging piece 16-2 on the inner surface of the ceiling of the cover 16 completely engages the engaging groove 42-3 of the upper surface of the nozzle base 42 and the engaging piece 16-3 on the inner surface of the lower end of the cover also completely engages the space between the engaging pieces 38 and 12-5.

In this way, the cover 16 is assembled to the inner assembly 52 and a pump dispenser 10 is manufactured. Contrary to this embodiment, the engaging piece 16-2 may be formed on the upper surface of the nozzle base 42 and the engaging groove 42-3 may be formed in the cover 16.

When, therefore, the assembly of the cover 16 to the inner assembly 52 is completed, the cover engages the inner assembly at the following three places:

(1) the engaging piece 16-2 on the inner surface of the ceiling of the cover 16 engages the engaging groove 42-3 of the upper surface of the nozzle base 42 from the right side;

(2) the generally semicircular engaging piece 16-3 on the inner surface of the lower end of the cover 16 engages the space between the generally semicircular engaging piece 38 on the valve housing 14 and the generally semicircular engaging piece 12-5 of the cylinder 12 from the right side; and (3) the engaging hole 16-1 in the upper surface of the ceiling of the cover 16 is fitted on the engaging projection 42-2 on the upper surface of the nozzle base 42 from above.

The engagements due to (1) and (2) prevent the cover 16 from rotating and moving vertically with respect to the inner assembly 52 and the engagement due to (3) prevent the cover 16 from moving rightward and leftward (forward and rearward) with respect to the inner assembly 52. In this way, the cover 16 is fixed to the inner assembly 52 and a pump dispenser 10 as a finished product can be obtained by preventing the cover 16 from rotating and moving vertically and horizontally.

According to the above-mentioned explanation, the cover 16 is pushed toward the inner assembly 52 from the right side to connect the cover 16 to the inner assembly 52. However, the cover 16 can be mounted on the inner assembly 52 by applying a horizontal force so that the cover and the inner assembly approach each other. Contrary to this embodiment, the inner assembly 52 may be pushed toward the cover 16 rightward, of course.

As mentioned above, according to this invention, all the structural elements of the pump dispenser 10 except for the cover 16 are assembled to form an inner assembly 52. Due to this unitary structure, the inner assemblies 52 which can be used commonly for the pump dispensers 10 can be mass produced. Only the covers 16 are manufactured according to the required custom designs independently of the inner assemblies 52 which are mass produced. The pump dispensers 10 having a variety of custom designs required by detergent distributors can be obtained by mounting the commonly manufactured inner assemblies 52 in the covers 16 having the required custom design. Thus, this unitary structure can be fully applied to a variety of the custom designs.

As all the structural elements of each pump dispenser 10 except for the cover 16 are unitarily assembled together to form an inner assembly 52, the common inner assemblies can be manufactured on a basis of mass production. Thus, the inner assemblies 52, i.e., the pump dispensers 10 can be manufactured at a low cost.

The pump dispenser 10 can be assembled merely by mounting the cover 16 of the specific design on the inner assembly 52. Thus, the pump dispensers 10 can be easily manufactured in a knockdown way, i.e., merely by supplying the inner assemblies 52 and the covers 16 to the assembling locations.

What is claimed is:

1. A pump dispenser comprising:

a cylinder having a vertical cylindrical portion defining a flow-in passageway therein, a horizontal cylinder body defining a pump chamber therein and extending horizontally from the vertical cylindrical portion and a horizontal nozzle holder provided over the cylinder body and extending from the vertical cylindrical portion in parallel with the cylinder body, the vertical cylindrical portion, the horizontal cylinder body and the horizontal nozzle holder being integrally formed;

a nozzle base mounted on a front end of the nozzle holder of the cylinder;

a nozzle mounted on a front end of the nozzle base and having a bottom portion formed with an orifice;

a trigger having an upper end swingably connected to the nozzle base and being capable of being pulled against a biasing force of a return spring;

a piston reciprocating in the horizontal cylinder body in cooperation with the movement of the trigger;

a valve housing connected to the vertical cylindrical portion of the cylinder from beneath thereof in an axial direction;

a bottle cap for mounting the valve housing through a packing on a neck portion of a container containing a liquid to be dispensed;

a primary valve for controlling the liquid from the container to the cylinder body;

a secondary valve for controlling the liquid from the cylinder body toward the orifice of the nozzle; and a hollow cover opened at a front face and a lower face thereof and having an reverse U-shaped cross section, for covering the cylinder and the nozzle base, a fitting projection is formed on an upper surface of the nozzle base and a fitting hole engageable with the fitting projection is formed in an upper surface of a ceiling of the nozzle base;

opposed horizontally extending engaging pieces are formed on a lower surface of the cylinder and an upper surface of the valve housing, respectively, and another horizontally extending engaging piece is formed on a lower end of the cover so as to be engageable with a space defined between the opposed horizontally extending engaging pieces when the valve housing is mounted on the cylinder; and either one of a horizontally extending engaging groove and a horizontally extending engaging projection engageable therewith is formed on the upper surface of the nozzle base behind the fitting projection of the nozzle base and the other one is formed on an inner surface of the ceiling of the cover.

2. The pump dispenser according to claim 1, wherein the fitting hole in the upper surface of the ceiling of the cover has a generally triangular form with an apex directed toward a front end of the cover and the fitting projection has a generally triangular shape complementary to the shape of the fitting hole.

3. The pump dispenser according to claim 2, wherein the horizontally extending engaging projection is suspended from the inner surface of the ceiling of the cover and has a generally inverse T-shaped cross section, and the horizontally extending engaging groove is formed in the upper surface of the nozzle base and has an upwardly opened generally inverse T-shaped cross section complementary to the cross section of the engaging projection.

4. The pump dispenser according to claim 1, whereto the horizontally extending engaging projection is suspended from the inner surface of the ceiling the cover and has a generally reverse T-shaped cross section, and the horizontally extending engaging groove is formed in the upper surface of the nozzle base and has an upwardly opened generally reverse T-shaped cross section complementary to the cross section of the engaging projection.

5. The pump dispenser according to claim 1, wherein the fitting hole in the upper surface of the ceiling of the cover has a generally triangular form with an apex directed toward a front end of the cover and the fitting projection has a generally triangular shape complementary to the shape of the fitting hole;

the horizontally extending engaging projection is suspended from the inner surface of the ceiling of the cover and has a generally reverse T-shape cross section, and the horizontally extending engaging groove is formed in the upper surface of the nozzle base and has an upwardly opened generally inverse T-shape cross section complementary to the cross section of the engaging projection; and the engaging pieces on the lower surface of the cylinder and the upper surface of the lower end of the cover are formed generally semicircular.

6. The pump dispenser according to claim 5, wherein the nozzle base is provided in both sides thereof with a pair of horizontally extending engaging grooves opened at a rear end of the nozzle base; and the nozzle holder is provided on both sides thereof with stoppers engageable with the engaging grooves of the nozzle base.

7. The pump dispenser according to claim 5, wherein means for preventing rotation of the valve housing is provided between the upper surface of the valve housing and the lower surface of the cylinder body.

8. The pump dispenser according to claim 5, wherein the return spring is molded from a plastics material, has a horizontal flat plate portion formed on a front end of the return spring and engageable with an engaging groove formed in a rear face of the trigger and is formed as a saddle-shaped plate spring riding on the cylinder body; and a pair of stoppers against which a rear end of the return spring abuts are formed on both lateral sides of the cylinder body.

9. The pump dispenser according to claim 1, wherein the nozzle base is provided in both sides thereof with a pair of horizontally extending engaging grooves opened at a rear end of the nozzle base; and the nozzle holder is provided on both sides thereof with stoppers engageable with the engaging grooves of the nozzle base.

10. The pump dispenser according to claim 1, wherein the valve housing is provided on an outer surface of a lower end thereof with an engaging projection to be engageable with the packing and with a flange having a shape of an inclined surface; and the bottle cap is opened at an upper surface thereof and has a downward inclined proximal portion which is formed so as to exceed the flange of the valve housing and to be engageable with the flange upon being pushed in from beneath of the valve housing.

11. The pump dispenser according to claim 1, wherein means for preventing rotation of the valve housing is provided between the upper surface of the valve housing and the lower surface of the cylinder body.

12. The pump dispenser according to claim 11, wherein the rotation preventing means comprises a pair of cylindrical portions engageable with each other and extending upward from the upper surface of the valve housing and extending downward from the lower surface of the cylinder body, respectively.

13. The pump dispenser according to claim 1, wherein the return spring is molded from a plastics material, has a horizontal flat plate portion formed on a front end of the return spring and engageable with an engaging groove formed in a rear face of the trigger and is formed as a saddle-shaped plate spring riding on the cylinder body; and a pair of stoppers against which a rear end of the return spring abuts are formed on both lateral sides of the cylinder body.

14. The pump dispenser according to claim 1, wherein the nozzle base is provided in both sides thereof with a pair of horizontally extending engaging grooves opened at a rear end of the nozzle base and a horizontally extending stopper engaging the engaging groove of the nozzle base is formed on a lateral side of the nozzle holder;

the valve housing is provided on the upper surface thereof with a cylindrical portion and the cylindrical body is provided on a lower surface thereof with a cylindrical portion corresponding to the cylindrical portion of the valve housing and engageable therewith;

the return spring is molded from a plastics material, has a horizontal flat plate portion formed on a front end of the return spring and engageable with an engaging groove formed in a rear face of the trigger and is formed as a saddle-shaped plate spring riding on the cylinder body;

a pair of stoppers against which a rear end of the return spring abuts are formed on both lateral sides of the cylinder body;

the valve housing is provided on an outer surface of a lower end thereof with an engaging projection to be engageable with the packing and with a flange having a shape of an inclined surface; and the bottle cap is opened at an upper surface thereof and has a downward inclined proximal portion which is formed so as to exceed the flange of the valve housing and to be engageable with the flange upon being pushed in from beneath of the valve housing.

15. The pump dispenser according to claim 14, wherein the piston is provided on rear half portion thereof with a depressed portion opened at a rear end of the piston, and the cylinder has a guide rod extending from a proximal portion of the cylinder body and loosely fitted in the depressed portion of the piston; and a pair of skirt-shaped seal pieces slidably contacting with an inner surface of the cylinder body are formed on a rear end of the piston with the piston.

16. The pump dispenser according to claim 1, wherein the piston is provided on rear half portion thereof with a depressed portion opened at a rear end of the piston, and the cylinder has a guide rod extending from a proximal portion of the cylinder body and loosely fitted in the depressed portion of the piston; and a pair of skin-shaped seal pieces slidably contacting with an inner surface of the cylinder body are formed on a rear end of the piston with the piston.

17. A method of assembling a pump dispenser comprising a cylinder including a vertical cylindrical portion, a cylinder body extending horizontally from the vertical cylindrical portion and a nozzle holder provided over the cylinder body and extending from the vertical portion in parallel with the cylinder body, a nozzle base mounted on a front end of the nozzle holder, a nozzle having a bottom portion formed with an orifice and mounted on a front end of the nozzle base, a trigger pivoted on the nozzle base and adopted to be pulled by an operator with a finger, a piston horizontally reciprocating in the cylinder body in cooperation with the movement of the trigger, a valve housing mounted on the vertical cylindrical portion of the cylinder from beneath thereof, a bottle cap for mounting the valve housing through a packing on a neck portion of a container containing a liquid to be dispensed, a primary valve for controlling the liquid from the container to the cylinder body, a secondary valve for controlling the liquid from the cylinder body to the orifice, a return spring for applying a biasing force to the trigger against a retraction of the trigger, and a hollow cover opened at a front face and a lower surface of the cover and having a generally U-shaped cross section, for covering the cylinder and the nozzle base, the method comprising:

(a) a step of forming an inner assembly including the steps of:

(a-1) disposing the nozzle in front of the nozzle base and disposing the trigger behind the nozzle base, mounting the nozzle on the front end of the nozzle base under a horizontal pushing force and pivotally supporting the trigger on lateral sides of the nozzle base;

(a-2) disposing the nozzle base together with the nozzle and the trigger in front of the nozzle holder of the cylinder with the secondary valve disposed therebetween, disposing the piston in front of the cylinder body and mounting the return spring on the cylinder body so as to ride thereon, mounting the nozzle base on the nozzle holder of the cylinder with the secondary valve held thereto under a horizontal pushing force, providing the return spring between the cylinder and the trigger, pivotally mounting a front end of the piston in a rear face of the trigger;

(a-3) disposing the valve housing under the vertical cylindrical portion of the cylinder with the primary valve disposed therebetween, and mounting the valve housing on the vertical cylindrical portion of the cylinder from beneath thereof trader a vertical pushing force with the primary valve held therein; and (a-4) disposing the bottle cap and the packing under the valve housing and mounting the bottle cap and the packing on a lower end of the valve housing so as to rest thereon, whereby the nozzle, the nozzle base, the trigger, the secondary valve, the piston, the return spring, the cylinder, the primary valve, the valve housing, the bottle cap and the packing are unitarily assembled together to form the inner assembly; and (b) a step of mounting the cover on the inner assembly including the steps of:

(b-1) disposing the cover behind the inner assembly, and pushing the cover toward the inner assembly under a horizontal pushing force, and further (b-1-1) fitting a lower end of the cover in a space between the cylinder and the valve housing from behind the space and holding the lower end of the cover therein, (b-1-2) mounting an inner surface of a ceiling of the cover on an upper surface of the nozzle base from behind and resting thereon, and (b-1-3) finally, fitting and holding a fitting projection formed on an upper surface of the nozzle base in a fitting hole of a surface of the ceiling of the cover so as to mount the cover on the inner assembly from behind.

18. The method of assembling the pump dispenser according to claim 17, wherein in the step of mounting the nozzle base on the cylinder, the horizontal pushing force is applied to at least one of the nozzle holder and the nozzle base until horizontally extending stoppers formed on both lateral sides of the nozzle holder engage a pair of horizontally extending engaging grooves formed in both lateral sides of the nozzle base.

19. The method of assembling the pump dispenser according to claim 18, wherein in the step of mounting the bottle cap and the packing on the valve housing the ;bottle cap is pushed upward until a proximal portion of the bottle cap opened at an upper surface of the bottle cap and inclining downward exceeds a flange formed on a lower end of the valve housing and forming an inclined surface so as to securely engage the proximal portion of the bottle cap with the flange; and the packing is raised so as to engage an engaging projection formed on an outer surface of the lower portion of the valve housing.

20. The method of assembling the pump dispenser according to claim 17, wherein in step of mounting the valve housing on the cylinder, a cylindrical portion extending downward from a lower surface of the cylinder body is fitted in a cylindrical portion extending upward from an upper surface of the valve housing.

21. The method of assembling the pump dispenser according to claim 17, wherein in the step of mounting the bottle cap and the packing on the valve housing, the bottle cap is pushed upward until a proximal portion of the bottle cap opened at an upper surface of the bottle cap and inclining downward exceeds a flange formed on a lower end of the valve housing and forming an inclined surface so as to securely engage the proximal portion of the bottle cap with the flange; and the packing is raised so as to engage an engaging projection formed on an outer surface of the lower portion of the valve housing.

22. The method of assembling the pump dispenser according to claim 17, wherein in step of mounting the valve housing on the cylinder, a cylindrical portion extending downward from a lower surface of the cylinder body is fitted in a cylindrical portion extending upward from an upper surface of the valve housing.

23. The method of assembling the pump dispenser according to claim 17 wherein in the step of mounting the nozzle base on the cylinder, the horizontal pushing force is applied to at least one of the nozzle holder and the nozzle base until horizontally extending stoppers formed on both lateral sides of the nozzle holder engage a pair of horizontally extending engaging grooves formed in both lateral sides of the nozzle base;

in the step of mounting the bottle cap and the packing on the valve housing, the bottle cap is pushed until a proximal portion of the bottle cap opened at an upper surface of the bottle cap and inclining downward exceeds a flange formed on a lower end of the valve housing and forming an inclined surface so as to securely engage the proximal portion of the bottle cap with the flange, and the packing is raised so as to engage an engaging projection formed on an outer surface of the lower portion of the valve housing; and in the step of mounting the valve housing on the cylinder, a cylindrical portion extending downward from a lower surface of the cylinder body is fitted in a cylindrical portion extending upward from an upper surface of the valve housing.

* * * * *